US009308969B2

(12) United States Patent
McEvoy

(10) Patent No.: US 9,308,969 B2
(45) Date of Patent: Apr. 12, 2016

(54) MOORING COMPONENT HAVING A SMOOTH STRESS-STRAIN RESPONSE TO HIGH LOADS

(75) Inventor: Paul McEvoy, Dublin (IE)

(73) Assignee: Technology From Ideas Limited, Waterford (IE)

( * ) Notice: Subject to any disclaimer, the term of this patent is extended or adjusted under 35 U.S.C. 154(b) by 0 days.

(21) Appl. No.: 14/006,481

(22) PCT Filed: Mar. 22, 2012

(86) PCT No.: PCT/EP2012/055151

§ 371 (c)(1), (2), (4) Date: Nov. 15, 2013

(87) PCT Pub. No.: WO2012/127015

PCT Pub. Date: Sep. 27, 2012

(65) Prior Publication Data

US 2014/0060413 A1 Mar. 6, 2014

(30) Foreign Application Priority Data

Mar. 22, 2011 (GB) ..... 1104818.8
May 27, 2011 (GB) ..... 1109120.4

(51) Int. Cl.
*B63B 21/00* (2006.01)
*B63B 21/20* (2006.01)

(52) U.S. Cl.
CPC ..... *B63B 21/20* (2013.01); *B63B 2021/005* (2013.01); *Y10T 29/49826* (2015.01)

(58) Field of Classification Search
CPC ..... B63B 21/00; B63B 21/04; B63B 21/20; B63B 2021/00; B63B 2021/003; B63B 2021/005; B63B 3/13; B63B 9/06; Y10T 29/49826; B25J 9/08; Y10S 901/01
USPC ..... 114/230.1, 230.2, 230.22, 230.24, 114/230.25, 230.26, 230.27, 230.28
See application file for complete search history.

(56) References Cited

U.S. PATENT DOCUMENTS 3,704,877 A 12/1972 Nunes et al.
3,839,983 A * 10/1974 McAusland ..... 114/183 A
(Continued)

FOREIGN PATENT DOCUMENTS

EP 132048 3/1985
EP 2298639 3/2011
(Continued)

OTHER PUBLICATIONS

"Seaflex Product Guide", Version 1.2, Jun. 21, 2004.

*Primary Examiner* — Daniel V Venne
(74) *Attorney, Agent, or Firm* — Diederiks & Whitelaw, PLC

(57) ABSTRACT

A mooring component comprises a plurality of different deformable elements formed of an elastomeric material. The component has a tensile length L and at least one of the elements has a length L'<L. As the mooring component comprises a plurality of different elastomeric elements, each having its own unique elastic (i.e. reversible) stress-strain response, the overall response of the component is a composite elastic response resulting from a combination of the responses of each of the plurality of elastomeric elements. The mooring component can form part of a mooring system for floating devices and sea-based structures such as renewable energy devices, including wave energy conversion devices, tidal turbines and tidal platforms, fish farms, oil rigs and off-shore wind farms, especially in low scope or high variability environments.

17 Claims, 16 Drawing Sheets

(56) References Cited

U.S. PATENT DOCUMENTS

| | | | | |
|---|---|---|---|---|
| 4,144,831 | A * | 3/1979 | Heydolph | 114/230.18 |
| 4,421,461 | A | 12/1983 | Hicks et al. | |
| 4,464,578 | A | 8/1984 | Masubuchi | |
| 4,534,262 | A | 8/1985 | Swenson | |
| 4,597,351 | A | 7/1986 | Brainard, II | |
| 5,408,946 | A * | 4/1995 | Jones et al. | 114/230.1 |
| 5,482,258 | A | 1/1996 | Clauson | |
| 5,483,911 | A | 1/1996 | Kubli | |
| 5,524,566 | A * | 6/1996 | Rapa et al. | 114/230.22 |
| 5,575,234 | A * | 11/1996 | Dysarz | 114/230.27 |
| 6,024,345 | A | 2/2000 | Nishio | |
| 6,202,263 | B1 | 3/2001 | Harker | |
| 6,439,147 | B2 * | 8/2002 | Cottrell et al. | 114/230.19 |
| 6,617,705 | B1 | 9/2003 | Smalser et al. | |
| 6,857,266 | B2 | 2/2005 | Dick | |
| 6,899,050 | B1 | 5/2005 | Huang | |
| 6,901,818 | B1 * | 6/2005 | Cheung | 73/862.393 |
| 6,930,406 | B2 | 8/2005 | Montgomery | |
| 7,385,301 | B2 | 6/2008 | Hirsch | |
| 7,458,135 | B2 | 12/2008 | Mikesell et al. | |
| 7,651,299 | B2 | 1/2010 | Huang | |
| 8,495,964 | B1 | 7/2013 | Ronald | |
| 8,550,526 | B2 * | 10/2013 | Wade | 294/191 |
| 8,667,791 | B2 * | 3/2014 | McEvoy et al. | 60/497 |
| 2006/0033252 | A1 | 2/2006 | Elmoselhy | |
| 2007/0289518 | A1 * | 12/2007 | Lawson | 114/230.27 |
| 2008/0314304 | A1 * | 12/2008 | Jayne | 114/230.17 |
| 2009/0202306 | A1 * | 8/2009 | Huang | 405/224 |
| 2010/0101474 | A1 | 4/2010 | McEvoy et al. | |
| 2011/0011322 | A1 | 1/2011 | Phillips | |
| 2012/0298028 | A1 * | 11/2012 | Parish et al. | 114/230.1 |
| 2013/0167764 | A1 * | 7/2013 | Zucco et al. | 114/230.16 |
| 2014/0060413 | A1 * | 3/2014 | McEvoy | 114/230.1 |

FOREIGN PATENT DOCUMENTS

| | | |
|---|---|---|
| FR | 2501739 | 9/1982 |
| FR | 2541730 | 8/1984 |
| GB | 2002052 | 2/1979 |
| GB | 21133111 | 8/1983 |
| JP | 48082278 | 11/1973 |
| JP | 58001843 | 1/1983 |
| JP | 61184238 | 8/1986 |
| JP | 2230969 | 9/1990 |
| JP | 9226012 | 9/1997 |
| JP | 2000108986 | 4/2000 |
| JP | 2002-002531 | 1/2002 |
| NL | 7608059 | 1/1978 |
| WO | WO 96/27055 | 9/1996 |
| WO | WO 99/10227 | 3/1999 |
| WO | WO 00/17519 | 3/2000 |
| WO | WO 03/106251 | 12/2003 |
| WO | WO 2004/085843 | 10/2004 |
| WO | WO 2005/028139 | 3/2005 |
| WO | WO 2006/052923 | 5/2006 |
| WO | WO 2007/137426 | 12/2007 |
| WO | WO 2011/033114 | 3/2011 |

* cited by examiner

| Mooring component | Horizontal mooring force (MN) Mean | Max | Variation |
|---|---|---|---|
| Steel catenary | 1.8 | 5 | 3.2 |
| Catenary with polymer lines | 1.8 | 5.4 | 3.6 |
| Taut elastomeric component | 3 | 3.5 | 0.5 |

80
81b
82
84
86b
86a
88
84
89b
84
81a
89a

MOORING COMPONENT HAVING A SMOOTH STRESS-STRAIN RESPONSE TO HIGH LOADS

CROSS-REFERENCE TO RELATED APPLICATIONS

This application represents a National Stage application of PCT/EP2012/055151 entitled "A Mooring Component Having a Smooth Stress-Strain Response to High Loads" filed Mar. 22, 2012, pending.

BACKGROUND OF THE INVENTION

The present invention relates to tethering components such as components for mooring a floating or submerged device or structure in a body of water. The components are particularly suitable for mooring applications where a small footprint and low scope operation are required.

Traditionally mooring components have been limited to near-shore use, for example tethering boats or pontoons to a pier or quay. Conventional mooring ropes are usually made from synthetic materials, such as polyester, nylon or Kevlar®. Although polyester and nylon mooring ropes are quite elastic, they can only deliver small elongations of the order of 10-25%. Conventional mooring ropes may also be made from wire filaments, which are extremely strong, but difficult to handle and maintain. A conventional mooring component made from a combination of wire rope and synthetic materials is often referred to as a hawser.

More recent advances in rope and cable technology have also seen the use of polymer materials between steel strands to help protect the ropes from fatigue in mining and oil/gas applications. Such protective sheaths of polymer material, for examples in many of Bridon's Dyform® ropes, do not make use of the polymer's elongation ability, as the elongation of the cable is limited by the steel strands. U.S. Pat. No. 4,534,262 and U.S. Pat. No. 4,597,351 contain examples of such a protective sheath approach. The strong sheath material can be braided like a rope but it is therefore also limited like a rope with similar maximum extensions. These maximum extensions depend on the braid design but are very limited and do not make use of the 100%+ extensions possible with an elastomeric material. Using existing braided nylon and polyester ropes would bring more benefit delivering higher load capacity for the same elongations. Furthermore the braiding itself becomes a wear issue on these types of designs suffering from the same wear problems that synthetic ropes have under cyclic load environments.

FR2501739 contains an alternative approach for a towing line, where a non-elastomeric bypass cable with a longer length than the core rubber section is used for protection from high loads. In this scenario the rubber core can now stretch to a far longer length before the steel bypass cable takes the load. The steel cable itself however is non-elastic and has an almost infinite slope (stress/strain) compared to the elastic core. This causes a significant problem with shock loads. Once the rubber core is stretched to its limits the steel cable protects it but high shock loads are generated causing higher peak loads and requiring thicker steel cables than may otherwise be desired. These high shock loads increase the anchor loads and the load on the device itself increasing fatigue damage and costs.

Seaflex® is an elastic mooring system for securing pontoons. The mooring component is a hawser comprising one or more rubber strands and a so-called bypass cable formed of stiff synthetic fibre or wire that prevents the rubber strand(s) from over-extending. The Seaflex® rubber hawser can withstand a force greater than 10 kN and more than 100% elongation to allow the mooring to take care of a degree of water level fluctuation. US2005/103251 and US2009/202306 are similar to the Seaflex approach and describe elastomeric mooring solutions where a steel bypass cable ("safety-locking loop") is used. In these cases a problem again occurs when the elastomeric ropes are fully extended and the steel cable engaged. Due to the almost infinite slope of the steel cable compared to the elastomeric ropes, high shock loads are created which can lead to fatigue, damage and higher anchor costs. In general these conventional steel bypass mooring solutions are only suitable for low load, near shore, sheltered applications, usually with multiple hawsers sharing the load.

However, conventional mooring solutions such as hawsers are not suitable for tethering devices to the seabed in deep water or for mooring in environments where the floating device is subject to large tidal currents and/or wave motion. Off the north coast of Scotland, for example, in a water depth of 40 m the waves will on average be less than 2 m high, increasing to up to an average 4 m during annual storms and an average greater than 5 m in a 100 year storm. The individual waves can be many times higher than the average, leading to changes in wave height of a significant fraction of the wave depth (low scope scenario). Conventional cables and hawsers either do not have the strength to withstand the forces imposed on a floating device by tidal movement and unpredictable storm waves, or else cost far too much to be able to install a system which can handle these forces.

There is therefore required another class of mooring components that can be used to tether floating devices and sea-based structures such as renewable energy devices, including wave energy conversion devices, tidal turbines and tidal platforms, fish farms, oil rigs and off-shore wind farms, especially in low scope or high variability environments. In these environments it is desirable to have a mooring solution which can deliver a low slope (ideally flat) load response under normal wave or tidal response, with a smoothly engaging high slope protective elastomeric response under more extreme environments. Ideally this engaging higher slope response would be non-linear with a continuing increase in slope with extension.

The main purpose of a mooring component is to control relative movement between the device being moored and its tether point. Such movement may be caused by wave and/or tidal motion. The mooring component must therefore apply a restoring force against movement of the device. It can be difficult to meet the demands on a mooring component where the device to be moored experiences relatively large displacements relative to the depth of water. In these environments it is desirable that the scope of the mooring is not too large, where the "scope" is defined as the length of mooring per unit of water depth. It is also desirable to minimise the footprint of the mooring system, where the "footprint" is the seabed area occupied by the mooring component.

FIG. 1 is a schematic diagram of a basic single point catenary mooring conventionally used to tether a floating structure 3 such as a tidal platform. The catenary mooring line comprises a free hanging line or cable 5, typically a steel chain, running horizontal to the seabed. The restoring force of the mooring line 5 is primarily generated by the hanging weight and pre-tension in the line. FIG. 1 shows that as the water depth increases due to large waves, the catenary chain 5 is lifted off the seabed 4 as the platform 3 drifts upwards and to the left. As the water depth decreases, the chain 5 is laid along the seabed 4 and the platform 3 drifts downwards and to the right. Thus very large amounts of chain and a large space envelope is required to allow horizontal movement of the platform as the water depths rise and fall. This results in very high material costs for the mooring system and restricts the positioning of the platform in an array. Catenary mooring systems can be used even in deep sea applications but the chain must be made so long that it does not exert any vertical load at the anchor point.

Due to the horizontal load reacting nature of the conventional drag embedded anchors which are used with catenary systems, the scope of the cable must be chosen such that the cable is never entirely picked up from the seabed for the given environmental conditions. Large waves can be up to 20 m high, i.e. the same order of magnitude as the water depth, and the length of chain required to deal with such changes then becomes very large. Normally a scope of three suffices, but in shallower water a scope of more than five is frequently required. Such a mooring system is often inefficient and takes up a lot of seabed space around the device, resulting in high costs and a large footprint. In the most extreme conditions the horizontal mooring force on a steel catenary system can be greater than 5000 kN. A further disadvantage of a catenary system is fatigue, as the mooring lines tend to wear at the seabed touch down point.

Accordingly there are a number of problems when it comes to implementing a catenary mooring system with a tidal platform or the like. In particular, very large scopes, seabed footprints and horizontal motion envelopes are required to allow the platform to ride the waves.

Alternative mooring systems do exist which can be more suitable to specific environments, such as using surface floats, or weights. These systems however also result in considerable additional cost and often suffer from similar problems of larger footprints and high forces. Many of these alternative approaches will use both steel cable and polyester ropes to try to overcome the challenges, but they cannot provide an adequate response to the movement of bodies in highly variable marine environments. Where they particularly suffer is in high peak forces or in large variations in force over time, resulting in higher fatigue.

As an alternative to catenary mooring systems, a limited number of elastic mooring components have become available which are taut as compared to a catenary system. As mentioned above, these cables usually comprise an elastomeric e.g. rubber material so as to allow the mooring to elongate to accommodate movement of a device, for instance due to tidal currents. In these mooring components one or more rubber strands may be combined in parallel with a so-called bypass cable formed of stiff synthetic fibre or wire that prevents the rubber strand(s) from over-extending. Such bypass cables however have a significant problem in that a typically non-smooth stress-strain response risks very high peak forces in response to elongation, causing fatigue and damage.

Mooring components comprising an elastomeric material are becoming popular in near shore and dock mooring applications. They provide a number of advantages over traditional mooring solutions by allowing a flexible component in the mooring system to stretch with the heave and surge of the vessel or device. They also cause less seabed damage, as additional slackness can be built into the mooring system. However, these mooring systems are principally designed to prevent drift of vessels and are not designed to provide low scope, small footprint performance in deeper waters. Current elastomeric solutions only work well where the change in wave height is small with respect to the depth of water in which the mooring is used, such as in-harbour pontoons, or in estuaries where tidal changes in water height are low.

Elastic mooring lines that comprise rubber elements and a stiff bypass cable to prevent over-extension are limited in the lengths to which they can be made, as the synthetic fibre or steel bypass cable can add disproportionately to the weight of the component. In practice such lines are no more than about 10 m long and therefore find most use in mooring pontoons and boats in a marina. The braided synthetic ropes in some of these moorings can also suffer from wear problems.

Furthermore these elastomer solutions all suffer from the same fundamental problem, namely that the diameter of elastomeric material required to deliver a restoring force in low wave scenarios is much smaller than the diameter required to withstand high forces. For normal rubber material, a counter force of ~MN as needed in high sea states would require material diameters >1 m. This diameter would exist along the entire length of the rubber component, resulting in unmanageable or uneconomic components. This therefore restricts the range of non-linear force response which can be delivered from conventional elastomer components to much smaller ranges, which cannot address the mooring needs in non-sheltered e.g. high wave environments. A steel bypass cable can of course deliver such force with a smaller diameter but if such a cable is included then the force response will not be smooth.

WO 2011/033114, published after the priority date of the present application, discloses a solution to this problem. It proposes using multiple different elastomer lengths with thicker and thicker elastomers, delivering higher and higher load protection, engaging at long and longer extensions. While this solution does indeed work, it suffers from the same problem highlighted above, namely that the thickness of elastomer required to withstand the high loads becomes very large. Furthermore, the thickest elastomers are also the longest elements in the component and therefore the entire device becomes unmanageable at larger sizes.

Although the currently available elastic lines such as Supflex® may be able to withstand severe weather conditions in sheltered environments without breaking, they provide a steeply increasing stress-strain response upon elongation and may therefore apply relatively high forces on the mooring system. While they may provide a non-linear stress-strain response to applied wave forces, they do not deliver the smooth performance and response curves required for more challenging mooring environments. In order to achieve the level of performance required for many offshore applications, a relatively large scope, that is, length per unit of depth and a large seabed footprint would be required with these moorings. This means that more material, or higher-grade material, would have to be used and the cost may become prohibitive.

Ideally, a deep sea mooring system needs to be adaptable to the sea states at the location at which it is placed and so it must be able to adjust its response to the applied forces from the waves over very short time periods. Ideally, such a mooring system is self-adjusting so that risk of failure in harsh environments is reduced. Ideally, the mooring system should absorb load forces at the lowest possible breaking limit. It should also be cost-effective.

SUMMARY OF THE INVENTION

The present invention seeks to provide improved mooring components and systems that can withstand relatively large changes in wave height and/or tidal motion while having a low scope and small footprint.

According to a first aspect of the present invention, there is provided a mooring component comprising a plurality of different deformable elements formed of an elastomeric material, wherein the component has a tensile length L and at least one of the elements has a length L'<L.

It is therefore recognised that a shorter elastomeric element may in fact be chosen to provide a greater stiffness than other, longer, elastomeric elements to provide protection from high loads as part of a smooth composite stress-strain response, that is, without the sudden shock forces typical of stiff bypass loops. This is a radical change in direction from the prior art where the additional safety tethers or bypass lines are longer than the tensile length of the component.

Thus in accordance with the invention there is provided a taut mooring component wherein elements are arranged to deform when a force is applied to extend the tensile length of the mooring component, for example because the component is connected to a body subject to tidal currents and/or waves. As the mooring component comprises a plurality of different elastomeric elements, each having its own unique elastic (i.e. reversible) stress-strain response, the overall response of the component is a composite elastic response resulting from a combination of the responses of each of the plurality of elastomeric elements. Furthermore, at least due to the difference in length between the elements, and to any other differences between the elastomeric elements, the overall stress-strain response is not linear. As a result of its non-linear response the mooring component can smoothly and gentle engage as it stretches.

In particular, in low scope or high variability environments it is desirable to have an elastomeric mooring component which can deliver a low slope (ideally flat) load response under normal wave or tidal response, with a smoothly engaging high slope protective response under more extreme environments. Ideally this engaging higher slope response would be non-linear with a continuing increase in slope with extension. The invention allows more complex non-linear stress-strain profiles to be achieved than can be provided by a single deformable element or by multiple elements that are the same in terms of composition and configuration. Advantageously, the different elastomeric elements may be chosen so as to tailor the overall composite non-linear response of the component to the expected environmental loading for the location at which the mooring system is to be used.

The tensile length L of the component is defined as the initial length that will stretch in response to applied force. The length L is measured in the unstretched state and corresponds to the zero strain point in the component's stress-strain response curve. Of course the component may have a physical length which is greater than the length L, for example because the elastomeric elements are attached to end connectors by non-deformable elements such as stiff synthetic or metallic cables. Such attachments means do not contribute to the non-linear elastic response of the components and are not taken into account when measuring the tensile length L.

Preferably the plurality of different deformable elements, or at least the elastomeric element of length L' and one or more elastomeric elements of length L, are connected in parallel in the mooring component. This means that the elements are arranged to respond to an applied tensile stress in parallel, so that the elastic constants of the elements will combine according to an inverse relationship rather than merely summing as when elastic elements are connected in series. The resulting composite stress-strain response will therefore contain weighted contributions from the different elements. A parallel arrangement can also allow the length of the component to be minimised while providing a number of different elastomeric elements to contribute to the overall non-linear elastic response. According to one set of embodiments the parallel arrangement may comprise a plurality of elastomeric elements extending side-by-side, possibly touching each other but preferably in a substantially non-contacting arrangement. Such arrangements may simplify design and assembly of the component. In other sets of embodiments the parallel arrangement may comprise a plurality of elastomeric elements that are laid, roped, wound, wrapped and/or braided together. Such arrangements may deliver a lower risk of entanglements but have a more complex assembly and design. Of course, a combined arrangement could also be used in the same component, with some elements wound together and others in a non-contacting arrangement.

The term "composite" as used herein indicates that the stress-strain response is a combined or cumulative or hybrid reversible non-linear stress-strain response. The mooring component comprises a plurality of different deformable elements and the resulting non-linear response is a combination of the responses of each of the plurality of different elements. Preferably the component has a complex non-linear stress-strain response within its normal operating range. Desirably, the component exhibits a plurality of non-linear stress-strain responses within its operating range.

Although some elastomeric materials and/or element configurations which provide a substantially linear elastic response may be used, it is preferable that each elastomeric element has a non-linear elastic response. This can make it easier to tailor the overall composite elastic response of the component to be non-linear and to vary in a sophisticated manner. It is further preferable that the combined i.e. composite response of the elements is smooth, containing no sudden steps in load or sharp changes in slope which could cause high shock loads in a mooring system.

It is also preferred that the elastomeric elements provide a passive elastic response, whether linear or non-linear. The term "passive" as used herein indicates that the stress-strain response of the tensile element is an inherent property that is a function of the material or materials comprised therein and/or the design, shape and/or configuration of the element. Accordingly it will be understood that a passive response does not require any additional input, e.g. such as air, hydraulic pressure, or an applied electric charge or voltage.

Because a composite non-linear response is provided, a single mooring component may effectively be tailored to cope with a number of sea states or environmental conditions. More complex stress-strain profiles may be achieved than is possible with conventional components. For example, the composite stress-strain profile may have a number of points of non-linearity, such that the component provides a sharp increase in counterforce at several thresholds or levels of applied force. In at least some parts of the composite stress-strain profile a substantially linear response may be provided, for instance between threshold points. A tailored non-linear composite stress-strain response can allow for a wide range of potential response curves to be designed for the mooring system, with desired reaction forces delivered at specific extensions of the component. Thus the load forces exerted on the mooring system can be reduced.

As a result of the combination of different elastomeric elements, the mooring component may have an improved ability to absorb forces across a wide range of operating conditions. At least some of the elastomeric elements may be able to provide large extensions, for example up to 300%, when stretching to accommodate movement of a device in the mooring system. The taut configuration and the deformability of the elements can significantly reduce the amount of material required in the mooring component and its size. This means that the scope, horizontal space envelope and seabed footprint of the mooring system may be reduced, while providing an improved response to a variety of environmental loads. The mooring system may therefore provide advantages including reduced cost and a greater packing density for floating devices.

Furthermore the Applicants have recognised that it can be beneficial to minimise the amount of elastomeric material in the mooring component not only to reduce cost but also to reduce the size and/or weight of the mooring component. The size and weight of a mooring component can be an important factor for transportation and installation. The higher the tensile strength of the material the smaller the diameter required to deliver a desired force. By providing that at least one of the elastomeric elements has a length L' that is less than the tensile length L of the component, less elastomeric material may be used. The composite response of the component may not be compromised, for example by designing the shorter element(s) having a length L' to be elements that provide a counterforce only at larger extensions. For example, at least one element having a length L the same as the tensile length of the mooring component may be stretched as soon as the component is under tension and provide an initial response, while another element having a length L'<L can be arranged such that it does not respond until a predetermined strain has been reached. These elements can be combined with non-elastic elements such as steel cable which may individually have lengths longer than L.

Each of the different deformable elements may be either tensile or compressive in response to an applied strain. Of course, for the mooring component to be able to stretch and allow a device to move within a certain motion envelope it must be tensile in its overall response. Preferably at least one element having a length L is a tensile element. However it will be appreciated that the composite non-linear elastic response may comprise both tensile and/or compressive contributions.

Preferably the component comprises at least one, two, three, four, five, six or more elastomeric elements arranged to provide a tensile response to an applied tensile stress.

Alternatively or additionally, preferably the component comprises at least one, two, three or more elastomeric elements arranged to provide a compressive response to an applied tensile stress.

In one preferred set of embodiments the mooring component comprises at least one tensile elastomeric element having a length L equal to the tensile length of the component and at least one deformable elastomeric element having a length L'<L. The deformable element of length L' may be a tensile element or a compressive element formed of elastomeric material. Preferably none of the elements are pre-strained when the component is at its unstretched length L.

In embodiments where an elastomeric element of length L' provides a tensile response, the element may simply be connected in the mooring component such that it is stretched as the mooring component undergoes extension beyond a certain threshold. In embodiments where an elastomeric element of length L' provides a compressive response, the element may be connected in the mooring component such that it is compressed between a fixed part and a part moving in response to extension of the component beyond a certain threshold. This is possible as one end of the mooring component is typically connected (directly or indirectly) to an anchor e.g. at the seabed and is therefore fixed, while the other end is connected (directly or indirectly) to a moving device at or near the surface. Further details of how the mooring component may be connected in a mooring system are discussed below.

The elastomeric element having a length L', and optionally other elements having lengths up to and including the initial tensile length L, may be operationally connected to contribute to the non-linear elastic response of the component in any suitable way. Preferably each elastomeric element is connected in the mooring component such that it contributes an elastic response (tensile or compressive) when the component reaches a certain extension from its initial tensile length. There is preferably provided at least one element that gives a tensile response as soon as the component extends from its initial length L. Other tensile elements may also be arranged to contribute to the composite response as the component is extended.

As well as selecting the different lengths of the elastomeric elements in the mooring component, the overall length of the component—which preferably is substantially the same as the initial tensile length L (e.g. after accounting for any end connectors)—can be selected depending on a number of factors including water depth, mooring system integration, component transportation and installation, and/or cost. Once a desired component length has been selected then this can be compared to the average wave height, and expected variations in wave height, at the location where the component is to be used. The required elongation range and stress-strain response of the component, as determined by the marine environment, is then used to design the selection of the elastomeric elements.

In determining the required elongation range of a component the orbital motion of the body being moored, which will depend on the wave states experienced, can be compared to the length of the component. The component is preferably designed such that it can stretch to accommodate the expected changes in motion while retaining a safety factor in its elastic response. The safety factor may vary from one component to another, for example depending on the elastomeric material of the elements, but may be related to a maximum elongation beyond which the component is expected to suffer from unacceptable levels of fatigue with respect to its intended period of service.

In some embodiments the composite reversible non-linear stress-strain response may comprise an initial increase in restoring force up to an elongation of 10-20% of the component's initial length. Additionally or alternatively, the response preferably provides a generally constant restoring force in at least a part of the normal operating range of the component, wherein the normal operating range can typically correspond to an elongation from 20% up to 200%, or more in certain situations. This normal operating range may correspond to the expected horizontal motion envelope of the tethered device under typical conditions at its location, e.g. taking into account usual wave heights and/or tidal currents. In at least some embodiments the element(s) are arranged to provide a response comprising a generally constant restoring force for an elongation in the range of one or more of: (i) 20-30%; (ii) 30-40%; (iii) 40-50%; (iv) 50-60%; (v) 60-70%; (vi) 70-80%; (vii) 80-90%; (viii) 90-100%; (ix) 100-110%; (x) 110-120%; (xi) 120-130%; (xii) 130-140%; (xiii) 140-150%; (xiv) 150-160%; (xv) 160-170%; (xvi) 170-180%; (xvii) 180-190%; and (xviii) 190-200%. Advantageously, the component may therefore be tailored to provide a near constant mooring force that restrains the device under normal conditions.

As is explained above, a mooring component of a given length can be designed through appropriate selection of the different elastomeric elements to provide the required elongation range depending on the mooring location. The elongation range may be determined from a ratio of the expected average wave height to the component length. While the range is generally chosen not to be so small that the elastomeric material in the component is wasted, the range may be limited so as to avoid fatigue over time and to include a certain safety factor. In at least some embodiments the component may provide a generally constant restoring force across a normal operating range of around 50-100% elongation, although this depends on the component's design and is purely given by way of example.

Ideally the tensile elastomeric response of the component is chosen to provide a generally constant restoring force across the normal operating range for a given mooring system. The length L of the component is thus chosen so that the desired maximum elongation is within the normal operating elongation of the elastomer(s) where fatigue is minimal (e.g. 100-150% of L for rubber). The additional elements are then designed to engage smoothly beyond this normal operating range, delivering further extension but with greatly increased load, protecting a device being moored under more extreme environmental conditions. In many mooring scenarios the normal operating extensions are defined by a combination of the current loads and the orbital motion of the waves (i.e. wavelength).

One or more elements having a length L' are preferably arranged so as to provide an additional response (tensile or compressive) only when the component reaches a certain extension from its initial tensile length. These elements may therefore be designed to restrain the device being moored when it is subject to unusual conditions such as high storm waves and/or tidal currents. In preferred embodiments the composite response may comprise a sharp increase in restoring force for elongations greater than 100%, 120%, 140%, 160%, 180%, 200%, 220%, 240%, or even greater than 250%. Again, these values are given by way of example only and will depend on the mooring location and choice of component design. This part of the response is preferably provided by the one or more elements having a length L'.

In one set of embodiments, the elements) having a length L° are operationally connected in the component by one or more additional tensile elements which are not elastomeric. The non-elastomeric elements may be made of cheaper or higher tensile strength materials such as steel cable. These non-elastomeric elements may also have a non-linear response, but preferably their elastic response is linear and much stiffer than that of the elastomeric elements. Although the additional tensile elements will contribute in some way to the overall composite response, they can be designed to provide a relatively low, and preferably constant or linear, elastic restoring force that does not substantially enter into the calculation of the tailored non-linear response. Accordingly it is preferably the elastomeric elements that provide most of the tailoring of the composite non-linear response.

In one preferred set of embodiments, each elastomeric element having a length L' is operationally connected in series with one or more additional tensile elements that are not elastomeric. These additional non-elastomeric element(s) may have an initial tensile length that combines with the length L' of the elastomeric element to match the tensile length L of the mooring component. In other words, the one or more non-elastomeric elements may have a total tensile length of L-L'. The one or more non-elastomeric elements may span the distance L-L' and preferably connect an elastomeric element having a length L' to the ends of the mooring component.

Preferably the additional tensile element(s) provide an elastic response to tensile stress. In some embodiments the additional tensile element(s) may comprise a slack cable, e.g. of synthetic or metallic material, having a physical length>the desired tensile length L-L' so as to allow for expansion. Thus it is only when the connecting cable(s) are pulled taut under tension that the short elastomeric element will start to experience a strain in its length L'. Preferably the cable is thin and/or made of a relatively lightweight material. This can help to save on material cost and weight. In other embodiments the additional tensile element(s) may comprise a non-elastomeric spring, such as a metal spring. Preferably the spring has a lower elastic modulus than the elastomeric element of length L'. Thus the non-elastomeric spring will tend to stretch first when a force is applied to the component, and the elastomeric element will only come under strain at larger extensions. The non-elastomeric tensile element is preferably strong, with a high ultimate tensile strength, so that it will not break when pulled taut and is able to transmit force to the elastomeric element.

Preferably the one or more elastomeric elements having a length L'<L are operationally connected in the component such that they only undergo strain when the extension of the component is at least 50%, 100%, 150%, 200%, 250%, 300% or more than 300%. As is explained above, this may be achieved in at least one set of embodiments by connecting the elastomeric element(s) in series with tensile element(s) having a lower elastic modulus (or higher tensile strength), such as metal springs. The elastomeric elements of length L' may be arranged to experience a positive (tensile) strain or a negative (compressive) strain. In the latter case, for example, the non-elastomeric element(s) connected in series with a compressive elastomeric element may pull on a moveable member that pushes the compressive element relative to a fixed member. In either case, upon reaching a predetermined strain threshold for the mooring component, the non-elastomeric element(s) are arranged to transmit strain to the shorter elastomeric element(s) so that they can start to contribute to the composite non-linear response of the component. The response may therefore be tailored to cope with extreme extensions, so that e.g. the mooring can respond to storm conditions and freak waves.

Thus it will be appreciated that according to the invention a tailored composite non-linear response can be achieved through selection of a number of different elastomeric elements, preferably connected in parallel, but with the amount of elastomeric material in the component being reduced by placing one or more shorter elastomeric elements in series with non-elastomeric elements that transmit strain to them at a certain extension threshold. Even though the shorter elastomeric elements may be thicker, so as to provide a stronger response, the material volume may still be less. The weight and cost of the component in terms of elastomeric material may therefore be reduced.

Several elastomeric elements having a length L'<L may be arranged in parallel with different lengths and/or thicknesses and/or materials. In at least some embodiments it may be preferred to use the same elastomeric material for the various elements. In such embodiments the elastomeric elements may differ in terms of their length and/or thickness.

In one set of preferred embodiments, the mooring component comprises a plurality of deformable elements comprising an elastomeric material wherein at least one element has a length L chosen from one of: (i) 4-6 m; (ii) 6-8 m; (iii) 8-10 m; (iv) 10-12 m; (v) 12-14 m; (vi) 14-16 m; (vii) 16-18 m; (viii) 18-20 m; or (ix) >20 m and wherein at least one element has a length L'<L chosen from one of: (i) 1-2 m; (ii) 2-4 m; (iii) 4-6 m; (iv) 6-8 m; (v) 8-10 m; (vi) 10-12 m; or (vii) 12-14 m. The choice of element lengths L and L' will be very dependent on mooring location and wave height. The tensile length L should preferably be equal to or greater than the wave height in a fairly common wave state so as to result in 100% or lower extension in this sea state, with higher seas state resulting in more extension and lower sea states in less. In at least some embodiments the component comprises a plurality of elastomeric elements each having a different length L'<L. These elements may cover a range of lengths up to the tensile length L. Preferably the elastomeric elements are connected in parallel. The composite response may therefore be tailored as a combination of the responses each of the different length elements. It will be appreciated that the mooring component can be made substantially shorter than existing products by using such combinations of elastomeric elements.

In other embodiments, alternatively or additionally, the cross-sectional area (thickness) of at least one element having a length L'<L may differ from that of one or more other elements, so that the composite response is a combination of the responses each of the different thickness elements. The thickness or diameter of the different elastomeric elements is preferably chosen from one of more of the ranges of: (i) 0.05-0.1 m; (ii) 0.1-0.2 m; (iii) 0.2-0.3 m; (iv) 0.3-0.4 m; (v) 0.4-0.5 m; (vi) 0.5-0.6 m; (vii) 0.6-0.7 m; (viii) 0.7-0.8 m; (ix) 0.8-0.9 m; and (x) 0.9-1.0 m.

It will be appreciated that the thickness and/or material chosen for the elements is very scale dependant. In a mooring component for a full scale wave energy conversion device, for example, forces are likely to be in the range of 1-10 MN during normal operation e.g. ~3 MN at 100% elongation could be expected. The overall material thickness in the component then depends on the material chosen and the elongation required. Elastomeric elements at ~100% elongation may typically deliver a tensile strength of 1.2 MPa and so for forces ~3 MN a total cross-sectional area of 3 MN/1.2 MPa=2.5 $m^2$ may be used. Rather than sharing the forces between six identical elements each having a diameter of 0.75 m, for example, the elements may have different thicknesses and/or materials in order to tailor the overall composite stress-strain response of the component.

It has been recognised that the amount of elastomeric material, especially in the shorter elements of length L', can be further reduced by using a stiffer elastomer e.g. one having a higher tensile strength than other of the elastomeric elements. Additionally or alternatively, it is therefore preferable that the one or more deformable elements having a length L'<L comprise an elastomeric material having a higher elastic modulus than the elastomeric material of element(s) having a length L (or a length>L' but less than L). These shorter elements may therefore be designed to contribute to the composite stress-strain response only at larger extensions, once the softer and longer elastomeric elements have stretched out. The shortest elements may be arranged to provide protection from extreme displacements, for example caused by storm waves.

The deformable element(s) having a length L'<L preferably comprise an elastomeric material having an elastic modulus of at least 1 MPa, 2 MPa, 3 MPa, 4 MPa, 5 MPa, 6 MPa or greater. Preferably there is provided at least one deformable element having a length L'<L comprising an elastomeric material having an elastic modulus of at least 6 MPa. For example, using a thermoplastic material for the shortest element may deliver a tensile strength 20-30 times higher than a rubber-based material and the element may therefore have a resulting lower diameter. Furthermore it is important that any such high tensile strength material can deliver that strength over a significant deformable length with respect to the wave height and not over a short impact time/distance. By incorporating such a high strength element, the mooring component may be better equipped to absorb large loads and protect against extreme waves or drift. In at least some embodiments, one or more element(s) having a length L may also comprise an elastomeric material having an elastic modulus of up to 6 MPa. Increasing the strength of the elastomeric elements in this way can lower the weight and volume of the component, but may make it more difficult to incorporate a "soft" response into the composite stress-strain curve at lower elongations. The weight reduction may also need to be balanced against the cost of a higher strength material.

The elastomeric material for the tensile/compressive elements may be chosen as one having an elastic modulus that will provide the desired degree of elongation and force for a particular mooring component. The elastomeric material may be thermoplastic or thermoset. Suitable elastomeric materials include natural rubber and synthetic rubbers such as polyurethane or SBR, and materials with a higher tensile strength such as Neoprene® or Viton®. These materials are suitable for marine use and may have extreme lifetimes of over 20 years. It is preferred that at least some of the elements, particularly elements having a length L, are formed of an elastomeric material that is capable of elongations of at least 75%, 100%, 150%, 200%, 250%, or greater than 250%.

Various elastomeric materials are available that can provide a relatively high elastic modulus and may be used to form short, stiff elements in the component, whether acting under tension or compression. However the Applicant has appreciated that one particularly advantageous form of elastomeric element that may be high in strength and low in material volume is a compressive element that is arranged to undergo (negative) strain in response to a tensile stress being applied to the component. Such a compressive elastomeric element having a length L'<L preferably has an elastic modulus of at least 10 MPa, 15 MPa, 20 MPa, 25 MPa, 30 MPa or greater. These elements may be used to deliver a high counterforce against extreme extensions of the component.

The Applicant has recognised that the benefits discussed above in terms of material and cost savings may be realised by incorporating one or more compressive elastomeric elements having a length L'<L into the mooring component. The compressive elements may have a higher strength than tensile elements and may therefore be able to contribute larger restoring forces, e.g. against extreme tidal drift or waves, using a lesser amount of material. It can be beneficial to combine both tensile and compressive elements in a mooring component as this may facilitate tailoring of the composite stress-strain response of the component with a minimal number of different elements. While the tensile element(s) can provide for elongations of 200%, 250% or more, and allow a rapid response to changing sea states with a high elongation rate, e.g. 10 m/s or greater, the compressive element(s) can additionally provide a large counter-force against extreme displacements at high strains where the tensile element(s) may have reached their tensile limit. Thus, while the tensile element(s) may deliver the main expansion of the mooring component at lower forces, the compressive element(s) may deliver the highest forces at large extensions. The resultant composite stress-strain response may be achieved regardless of the materials used.

The compressive element may have any suitable form, for example a compression spring. However, for structural stability and ease of manufacture, preferably the compressive element comprises a cylindrical corrugated or bellowed member formed of elastomeric material. In a set of preferred embodiments the elastomeric element of length L'<L therefore takes the form of a compressive element comprising a cylindrical corrugated or bellowed member formed of elastomeric material.

The compressive member may be a solid cylinder; however, preferably the cylindrical member takes the form of a hollow cylinder or tube, having corrugations or bellows in its side walls, so as to extend its range of movement. Such a hollow structure allows for a tailored stress strain response from the high tensile strength material over a significant deformation length, enabling the component to respond to large variations in wave height relative to its length. The cylindrical member can act under axial compression (i.e. compressive forces acting along its longitudinal axis) to provide a non-linear response. The corrugations/bellows and the elastomeric material itself may compress axially in such a way that the force required to compress the damping means increases more steeply as the degree of compression increases. Such compressive elements are therefore particularly well suited to providing a strong counterforce against large displacements in the composite non-linear stress-strain response of a mooring component.

The bellowed structure of a compressive element and the fact that it is made from elastomeric material can permit the mooring counterforce to increase non-linearly with respect to both the applied force and the rate of change of the applied force. For normal waves, the mooring counterforce may be very low, and the movement of an object being moored in response to the waves may not be substantially affected by the compressive element(s) in the mooring component. However, when the force applied (or the rate of change of the applied force) exceeds a threshold, for example, in the case of an extreme wave, the mooring counterforce may be much higher, thereby preventing extreme movement of the moored object beyond its normal motion envelope. The compressive element(s) can thereby prevent breakage of the mooring component under extreme conditions.

It will be appreciated that incorporating a compressive element comprising a cylindrical corrugated or bellowed member formed of elastomeric material into a mooring component may beneficially allow the component to respond to extreme conditions whether or not there are provided other elements formed of an elastomeric material. This feature is therefore considered novel and inventive in its own right, and thus according to a second aspect of the present invention there is provided a mooring component comprising at least one tensile element and at least one compressive element, both the tensile and compressive elements being arranged to undergo strain in response to a tensile stress. Preferably the at least one tensile element and at least one compressive element are arranged in parallel. Additionally or alternatively, it is preferred that the at least one tensile element and/or the at least one compressive element are formed of an elastomeric material.

It will be understood that a mooring component according to this aspect of the invention represents a significant deviation from the structure of standard mooring components, which comprise only tensile elements that stretch in response to a tensile stress being applied. To the Applicant's knowledge it has not previously been proposed to combine both tensile and compressive elements together in a mooring component, preferably in parallel, with both of the elements responding to tensile stress i.e. reacting to elongation of the component. Of course, one of the elements, for example the compressive element, may be arranged to act only above a certain strain threshold, as is described above. An advantage of both tensile and compressive elements contributing to the composite tensile stress-strain response of the component is that the response can be better tailored to the marine conditions at the location of the mooring. While the tensile element (s) may deliver the main expansion of the component at lower strains, the compressive element(s) may deliver stronger counterforces at higher strains (or vice versa).

Preferably the compressive element comprises a cylindrical corrugated or bellowed member formed of elastomeric material. Such elements, as discussed above, have been found to be able to provide a very high modulus of elasticity while minimising the amount of elastomeric material required.

The one or more tensile elements may be formed of any suitable elastic material, including synthetic and/or metallic fibres. An elastic spring may be used. However, in at least one set of preferred embodiments the at least one tensile element comprises an elastomeric material, so as to provide the component with a large degree of extensibility, e.g. 200% or more. A plurality of different tensile elements comprising an elastomeric material may be provided. Thus any of the preferred features described hereinabove may be incorporated, either alone or in combination, except where mutually exclusive, in the second aspect of the invention. Thus according to one set of preferred embodiments the component may comprise at least one compressive element comprising a cylindrical corrugated or bellowed member formed of elastomeric material arranged in parallel with one or more tensile elements formed of an elastomeric material. The compressive element may have a length L' that is less than the tensile length L of the component. Such a combination has been found to provide the benefit of a highly tailorable composite non-linear stress-strain response for a reduced material volume.

Thus according to a further aspect of the present invention there is provided a mooring component comprising a plurality of different deformable elements formed of an elastomeric material and arranged in parallel so as to respond to tensile stress, wherein at least one of the elastomeric elements is a tensile element having a length L corresponding to the unstretched length L of the component and at least another of the elastomeric elements is a compressive element having a length $L'<L$. Preferably the compressive element comprises a cylindrical corrugated or bellowed member formed of elastomeric material. Any of the preferred features described above may also be applied, either alone or in combination, to this further aspect of the invention.

By combining preferably lower strength, higher elongation tensile elastomeric elements with preferably higher strength compressive elastomeric elements, a composite non-linear stress-strain response can be achieved that provides high extensibility (typically >100%) while also withstanding forces of several MN. Such a hybrid tensile/compressive mooring component has been found to deliver highly customisable composite stress-strain responses while also limiting the material volume/weight of elastomeric material used, e.g. as compared to a mooring component comprising tensile elastomeric elements alone.

There will now be described some preferred features of compressive cylindrical elastomeric elements that are applicable to embodiments of each of the aspects of the invention outlined above.

The terms "cylinder" and "cylindrical" as used herein include not only members of constant average cross-sectional circumference as one moves along the member in the axial direction, but also cylinders with changing cross-sectional circumference as one moves along the member in the axial direction, such as cone-shaped cylinders and truncated cones. In one set of embodiments, the compressive member is in the form of a truncated hollow cone, having circumferential bellows in the side walls (i.e. the average cross-sectional circumference of the bellows increases as one moves axially along the member). Alternatively, the compressive member may be in the form of a hollow tube having circumferential bellows in the side walls (i.e. the average cross-sectional circumference of the bellows does not substantially increase as one moves axially along the member). The terms also include such shapes having non-circular cross-sections, for example, oval cross-sections or polygonal cross-sections (e.g. square, rectangular, hexagonal, octagonal, etc.). Non-hollow cylinders are also included.

The load response of a bellowed cylindrical member may be controlled through design of the corrugations (convolute diameter). It is possible to vary the response of the cylindrical member by varying the ratio of the diameter of the peaks to the diameter of the valleys by means of varying the diameter/radius of the peaks and diameter/radius of the valleys, by varying the number of bellows/convolutes, by varying the pitch, or by varying the fillet radius at minimum outer diameter of bellows and the fillet radius at maximum outer diameter of bellows. It is also possible to vary the response of a hollow cylindrical member by varying the wall thickness. The cylindrical member can comprise circumferential corrugations, bellows or convolutes all along its length or can comprise corrugations, bellows or convolutes being interrupted by smooth regions.

In one set of embodiments, the mooring component comprises at least one cylindrical corrugated or bellowed member formed of elastomeric material that has a length L'<L chosen from one of: (i)<0.5 m; (ii) 0.5-1 m; (iii) 1-2 m; (iv) 2-3 m; (v) 3-4 m; (vi) 4-5 m; or (vii) >5 m. The diameter of the at least one cylindrical corrugated or bellowed member formed of elastomeric material is preferably chosen from one of: (i)<0.1 m; (ii) 0.1-0.2 m; (iii) 0.2-0.4 m; (iv) 0.4-0.6 m; (v) 0.6-0.8 m; (vi) 0.8-1.0 m; (vii) 1.0-1.2 m; (viii) 1.2-1.4 m; (ix) 1.4-1.6 m; (x) 1.6-1.8 m; (xi) 1.8-2.0 m; or (xii) >2.0 m. Preferably the at least one cylindrical corrugated or bellowed member is connected in parallel with one or more other elastomeric elements, preferably tensile elastomeric elements. The tensile elastomeric elements may have a range of different lengths up to the tensile length L, for example lengths in the range of 2-20 m. The tensile elastomeric elements may have a range of different thicknesses but they are preferably thinner than the at least one cylindrical corrugated or bellowed member, for example thicknesses in the range of 0.1-1.0 m. The composite response may therefore be tailored as a combination of the responses each of the different tensile and compressive elastomeric elements. It will be appreciated that the mooring component can be made substantially shorter than existing products by combining at least one elastomeric compressive element comprising a cylindrical corrugated or bellowed member with one or more elastomeric tensile elements.

The choice of elastomeric material for the corrugated cylindrical member can be important. Although the elastomeric material may be thermoplastic or thermoset, preferably the elastomeric material is thermoplastic, so as to facilitate manufacture and reduce production costs. The thermoplastic material may be a thermoplastic polyurethane (TPU), a thermoplastic vulcanizate (TPV) i.e. consisting of a continuous thermoplastic phase with a phase of vulcanized elastomer dispersed therein, a thermoplastic polyolefinic elastomer (TPO), a styrenic thermoplastic elastomer (TPS), a thermoplastic polyamide block copolymer (TPA), or a copolymer such as a copolyetherester or copolyesterester. TPVs combine many desirable characteristics of cross-linked rubbers with some characteristics like processability of thermoplastic elastomers.

Thermoset and elastomeric materials, like cross-linked rubbers such as natural rubber, styrene butadiene rubber, neoprene CR, EPDM (ethylene propylene diene monomer), HNBR (hydrogenated nitrile butadiene rubber), NBR (nitrile butadiene rubber), ACM, AEM, EVA, CM, CSM, CO, may also be used for the corrugated cylindrical member.

A preferred elastomeric material for the corrugated cylindrical member is Hytrel® available from E. I. du Pont de Nemours and Company, Wilmington, Del. Hytrel® is a thermoplastic copolyetherester elastomer combining the flexibility of rubbers, the strength of plastics and the processability of thermoplastics. It has exceptional environment stability including chemical resistance, seawater compatibility and resistance to ageing and compression set over a broad temperature range. It is also easier and more cost-effective to process than rubber and, unlike rubber and thermoset elastomers, it is also recyclable. It can be readily formed into compressive elements by a variety of thermoplastic processing techniques, including injection moulding, extrusion, blow moulding, rotational moulding, and melt casting. In particular, corrugated extrusion may permit for easy and cost-effective manufacture of hollow tubes having convolutes. Processing temperatures are between 177 and 260° C.

According to one set of embodiments the corrugated cylindrical member is made from a polymer or polymer blend comprising: a copolyester thermoplastic elastomer (TPC) such as a copolyetherester or copolyesterester, which are copolymers that have a multiplicity of recurring long-chain ester units and short-chain ester units joined head-to-tail through ester linkages, said long-chain ester units being represented by formula (A):

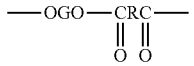

(A)

and said short-chain ester units being represented by formula (B):

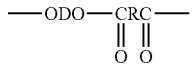

(B)

wherein:

G is a divalent radical remaining after the removal of terminal hydroxyl groups from poly(alkylene oxide)glycols having preferably a number average molecular weight of between about 400 and about 6000;

R is a divalent radical remaining after removal of carboxyl groups from a dicarboxylic acid having a molecular weight of less than about 300; and D is a divalent radical remaining after removal of hydroxyl groups from a diol having a molecular weight preferably less than about 250; and wherein said copolyetherester(s) preferably contain from about 15 to about 99 wt % short-chain ester units and about 1 to about 85 wt % long-chain ester units.

As used herein, the term "long-chain ester units" as applied to units in a polymer chain refers to the reaction product of a long-chain glycol with a dicarboxylic acid. Suitable long-chain glycols are poly(alkylene oxide) glycols having terminal (or as nearly terminal as possible) hydroxy groups and having a number average molecular weight of from about 400 to about 6000, and preferably from about 600 to about 3000. Preferred poly(alkylene oxide) glycols include poly(tetramethylene oxide) glycol, poly(trimethylene oxide) glycol, poly (propylene oxide) glycol, poly(ethylene oxide) glycol, copolymer glycols of these alkylene oxides, and block copolymers such as ethylene oxide-capped poly(propylene oxide) glycol. Mixtures of two or more of these glycols can be used.

The term "short-chain ester units" as applied to units in a polymer chain of the co-polyetheresters refers to low molecular weight compounds or polymer chain units. They are made by reacting a low molecular weight diol or a mixture of diols with a dicarboxylic acid to form ester units represented by formula (B) above. Included among the low molecular weight diols which react to form short-chain ester units suitable for use for preparing copolyetheresters are acyclic, alicyclic and aromatic dihydroxy compounds. Preferred compounds are diols with about 2-15 carbon atoms such as ethylene, propylene, isobutylene, tetramethylene, 1,4-pentamethylene, 2,2-dimethyltrimethylene, hexamethylene and decamethylene glycols, dihydroxycyclohexane, cyclohexane dimethanol, resorcinol, hydroquinone, 1,5-dihydroxynaphthalene, etc. Especially preferred diols are aliphatic diols containing 2-8 carbon atoms, and a more preferred diol is 1,4-butanediol.

Preferably the elastomeric material of the corrugated cylindrical member has a tensile strength (at yield) between 5 and 100 MPa, preferably around 30 MPa. The tensile modulus of elasticity (e.g. measured according to ISO 527-1/-2) may be up to 20,000 MPa, but is preferably between 25 MPa and 1200 MPa, most preferably between 100 and 600 MPa.

Some general features of the mooring component that are applicable to all of the aspects of the invention discussed above will now be described.

Whether the deformable elements comprise a plurality of tensile and/or compressive elements, it is preferable for the elastomeric elements to be connected together at least at the ends of the mooring component. This can ensure that the tensile stress applied to the component is shared between the different elements. Attachment means are preferably provided at the ends of the component. Such attachment means may be designed and optimised for connecting the mooring component to other components in a mooring system, for example to tether lines and anchors. In one set of embodiments the plurality of elastomeric elements are connected between the attachment means, preferably in a parallel arrangement. What is meant by a parallel arrangement is that the elements are arranged to respond to an applied tensile stress in parallel. The elements may be physically located parallel to one another, but could also be laid, wound or wrapped around one or more of another as is mentioned above. As is also described above, other non-elastomeric elements may be connected in series with the elastomeric elements and thus may link the elastomeric elements to the end attachment means. The attachment means are preferably non-elastic and act to transmit tensile stress to the elements inside the mooring component.

The attachment means provided at the ends of a mooring component may be in the form of an end connector separate from the tensile and/or compressive elements. This can provide component manufacturers with the capability to design the end connectors independently of the elements that provide the component's tensile response. Alternatively the attachment means may be integrally provided by one or more of the tensile and/or compressive elements. In a preferred set of embodiments the mooring component comprises one or more tensile elastomeric elements of length L which include integrally formed end connectors. For example, an end connector may be moulded into an elastomeric element. One or more such end connectors may make up the attachment means, thereby removing the need for a separate end connector and its link(s) to the element(s). The end connectors may be formed by a thickened portion of elastomeric material so that they are stiffer than the main element.

In preferred embodiments, the mooring component is relatively short in its unstretched state. For example, a 15 meter long component capable of stretching to 40 meters can reduce the footprint of a mooring system from 150 meters to 40 meters. The elongation of the component will depend on its operating conditions, such as the size of the waves and/or tidal current. As the orbital movement of a device tethered by a mooring component according to embodiments of the present invention may be more restrained as compared to its movement in a conventional e.g. catenary mooring system, this can ensure that the stress along the component itself is essentially constant. In at least one set of embodiments the mooring component preferably has a tensile length L chosen from: (i) 5-10 m; (ii) 10-15 m; (iii) 15-20 m; (iv) 20-25 m; or (v) 25-30 m. This is the length of the component measured in an unstretched state. A preferred length for the mooring component in one set of embodiments is 12-16 m.

The present invention also extends to a mooring system comprising a mooring component as described hereinabove. In a preferred set of embodiment the component is submerged and is connected, directly or indirectly, between a floating body and the seabed. For example, the component may be connected between a floating body, such as a floating fish farm, a floating platform or a floating wind farm, and the seabed. The mooring system may comprise one or more mooring components, and a combination of different mooring components may be used. The mooring system may be a mooring system for a deep sea environment, a tidal flow environment or a tidal barrage environment.

In another set of embodiments the component is connected between two (or more) floating bodies. The connection may be direct or indirect. Thus it is preferred in some embodiments that the component is connected, directly or indirectly, between a first floating body and a second floating body and optionally, the floating bodies form part of an array. In such embodiments the mooring component can respond to movement of one floating body by reacting against another floating body that may have greater inertia.

In preferred embodiments, the possible elongation of the component (i.e. the available stretch) is such that a minimum length of component is required to achieve the desired performance. Preferably the component is capable of elongations up to 300%. In at least some embodiments of a mooring system, the component is placed close to the ocean surface (when part of a larger mooring system) to minimise stress on the rest of the mooring system. This ensures that the wave or tidal motion causes only the mooring component (and not the entire mooring system) to stretch. In at least some embodiments of a mooring system, the component is connected between a floating member and a conventional mooring line such as a synthetic rope (e.g. Dyneema®) and/or steel chain. The connection may be direct or indirect. One or more of the mooring components may be connected, either in series or in parallel.

In a set of preferred embodiments the mooring system comprises a floating platform and the mooring component is connected between the platform and the seabed. In at least some embodiments the mooring component is preferably connected between the floating platform and a mooring line that is connected to the seabed. The mooring line may comprise a synthetic rope or steel chain. The component may also be connected to the platform by a conventional mooring line, such as a synthetic rope. The floating platform may form part of a tidal or wave energy conversion device.

According to a further aspect of the invention, there is provided a method of manufacturing a mooring component for a deep sea mooring system, comprising the steps of: identifying a body to be moored and a location in which it is to be moored; determining the expected environmental loading on the body at the location; determining the stress-strain response required for the component to respond to the expected environmental loading with a desired modification of the mooring forces on the component; and forming the mooring component from a plurality of different deformable elements formed of an elastomeric material, wherein the component has a tensile length L and at least one of the elements has a length L'<L, such that the required response of the component is a composite reversible non-linear stress-strain response which is a combination of the responses of each of the plurality of elastomeric elements and which provides the desired modification of the mooring forces on the component.

According to a yet further aspect of the invention, there is provided a method of manufacturing a mooring component for a deep sea mooring system, comprising the steps of: identifying a body to be moored and a location in which it is to be moored; determining the expected environmental loading on the body at the location; determining the stress-strain response required for the component to respond to the expected environmental loading with a desired modification of the mooring forces on the component; and forming the mooring component from at least one tensile element and at least one compressive element, both the tensile and compressive elements being arranged to undergo strain in response to a tensile stress, such that the required response of the component is a composite reversible non-linear stress-strain response which is a combination of the responses of the elements and which provides the desired modification of the mooring forces on the component.

According to a yet further aspect of the invention, there is provided a method of manufacturing a mooring component for a deep sea mooring system, comprising the steps of: identifying a body to be moored and a location in which it is to be moored; determining the expected environmental loading on the body at the location; determining the stress-strain response required for the component to respond to the expected environmental loading with a desired modification of the mooring forces on the component; and forming the mooring component from a plurality of different deformable elements formed of an elastomeric material and arranged in parallel so as to respond to tensile stress, wherein at least one of the elastomeric elements is a tensile element having a length L corresponding to the unstretched length L of the component and at least another of the elastomeric elements is a compressive element having a length L'<L, such that the required response of the component is a composite reversible non-linear stress-strain response which is a combination of the responses of the elements and which provides the desired modification of the mooring forces on the component.

While various aspects and embodiments of the invention have been described in the context of mooring components and systems that control the movement of floating objects subject to wave and/or tidal motion, the components and systems described above may also find applications beyond marine mooring. In particular, a component comprising at least one tensile elastomeric element and at least one compressive elastomeric element, both the tensile and compressive elastomeric elements being arranged to undergo strain in response to a tensile stress, may find use in tethering objects in a non-marine environment. Any of the features described above may potentially be equally applicable even in a non-marine environment.

The present invention therefore extends to a tether comprising at least one tensile elastomeric element and at least one compressive elastomeric element, both the tensile and compressive elastomeric elements being arranged to undergo strain in response to a tensile stress.

It will be appreciated that certain preferred features of the invention, which are, for clarity, described above in the context of separate embodiments, may also be provided in combination in a single embodiment. Conversely, various preferred features of the invention which are, for brevity, described in the context of a single embodiment may also be provided separately or in any suitable sub-combination.

BRIEF DESCRIPTION OF THE DRAWINGS

Some preferred embodiments of the present invention will now be described, by way of example only, and with reference to the accompanying drawings, in which.

DETAILED DESCRIPTION OF THE INVENTION

Figure 1:
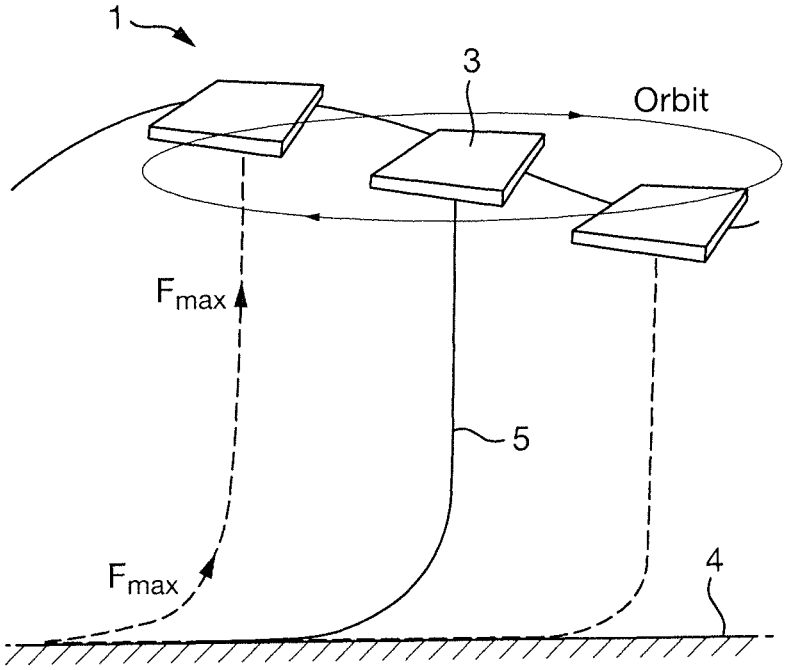
Fig. 1 Prior Art
FIG. 1 is a schematic representation of a prior art catenary mooring system.
Figure 2:
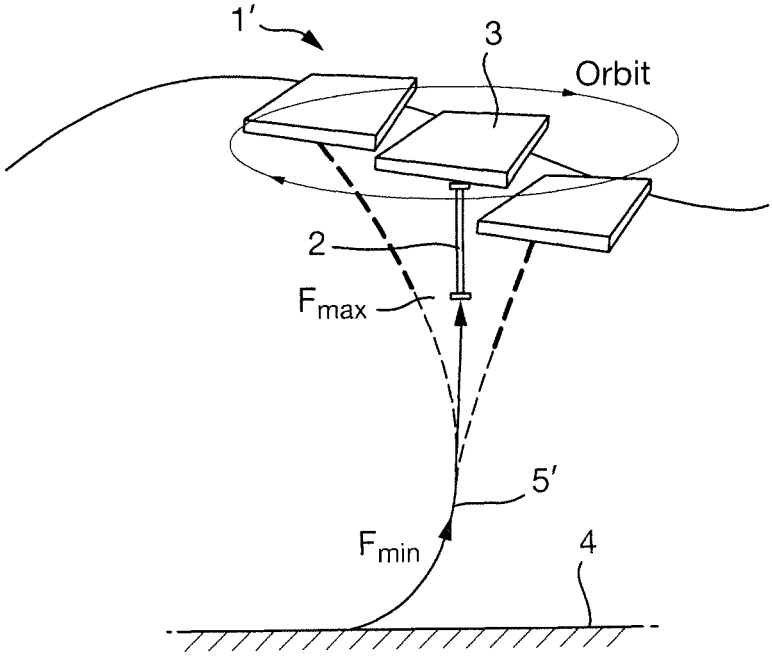
FIG. 2 is a schematic representation of a mooring system according to an embodiment of the present invention.

FIG. 1 (previously discussed above) depicts a conventional catenary mooring system 1 while FIG. 2 relates to a taut mooring system 1' comprising a mooring component 2 according to an embodiment of the present invention. In these Figures a floating platform 3 is connected to the seabed 4 by a mooring line 5, 5'. FIG. 1 shows a long catenary line 5 such as a steel chain. It can be seen from FIG. 1 that the circular motion of the platform 3 caused by the waves results in a large horizontal motion envelope for the mooring line 5 as it is picked up from the ocean floor 4. As the water depth increases due to large waves the catenary chain 5 is lifted off the seabed and the platform 3 moves upwards and to the left. For small waves, the chain 5 is laid along the seabed 4 as the water depth decreases and the platform 3 drifts downwards and to the right. Thus very large amounts of chain and a large space envelope is required to allow horizontal movement as water depths rise and fall. The large footprint of the mooring system 1 restricts the positioning of the platform 3 in an array. Furthermore the mooring forces on the component are high ($F_{max}$) and transmitted through the entire chain, experienced at all points.

In FIG. 2, on the other hand, it can be seen that the taut configuration of a mooring component 2 according to the present invention is able to achieve a low scope with a relatively small horizontal motion envelope and small seabed footprint. This results from the high extensibility of the mooring component 2 as compared to a catenary system 1 e.g. using steel chains. The taut configuration of the mooring component 2 significantly reduces the amount of material required, so the orbit of the platform 3 is smaller as the wave heights vary. This allows for greater packing density of floating platforms in an array, for example an array of renewable energy devices such as tidal turbines or wave energy conversion devices. Furthermore the mooring forces in the system are reduced ($F_{min}$) without a large weight of chain to pick up off the seabed.

It can be seen from FIG. 2 that the mooring component 2 (shown schematically) may be incorporated as a tether connected between the platform 3 and a smaller chain 5' in the lower section of the mooring system 1'. The mooring component 2 absorbs the majority of the mooring forces ($F_{max}$) with the chain 5' simply providing a connection to the seabed 4. The elastomeric component 2 can deliver a tailored counter force on the platform 3 and chain 5' as the separation between them increases, significantly reducing the load forces ($F_{min}$) exerted on the lower chain 5. The elastomeric component 2 may be connected to any conventional mooring line 5', such as a steel chain or Dyneema® line.

It can also be seen from FIG. 2 that the vertical movement of a floating platform 3 may remain substantially the same but the effect on the rest of the mooring system 1' is substantial in terms of the forces experienced. The forces on the mooring component 2 may be reduced as the elastomeric elements can elongate to accommodate the motion of the platform 3. Typically, the total cross sectional area of the rest of the mooring system 1' may be reduced by more than 30% when compared with traditional mooring lines 5, thereby significantly reducing costs.

Figure 3:
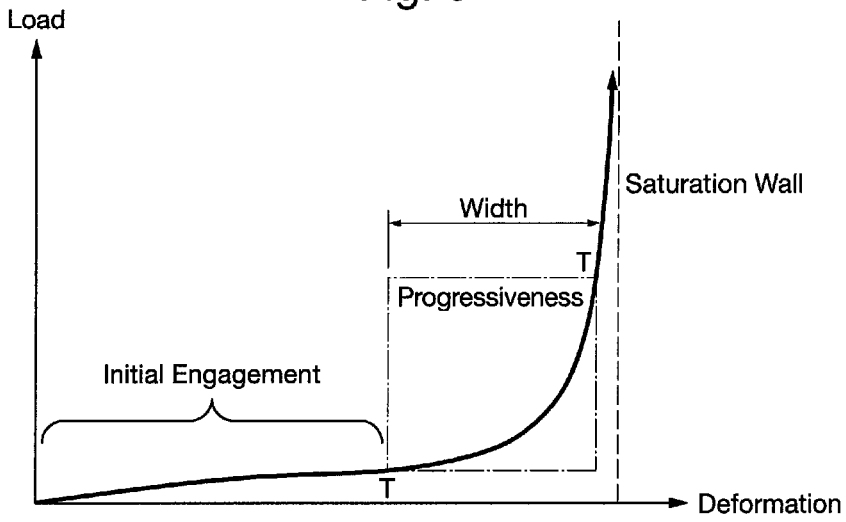
FIG. 3 is an example of a composite response curve for a mooring component according to an embodiment of the present invention.

FIG. 3 is a graph showing the deformation of a mooring component according to the present invention versus the load applied by the component according to a reversible non-linear composite stress-strain response. The "initial engagement" region of FIG. 3 shows the ideal response under normal wave conditions, the "progressive" region shows the ideal response under extreme conditions, and the "saturation" region shows the ideal response when the conditions become so extreme that a protective function is necessary. It can be seen that the stress-strain response is ideally a smooth curve without any sharp changes of gradient. Moreover the mooring forces on the component are maintained at a relatively low level through the "initial engagement" and "progressive response" regions, which is a result of the gradual deformation of the elastomeric elements. Such a response curve is quite different to that seen in a catenary system, where mooring forces are generally higher and may suddenly increase in response to changes in wave height.

Figure 4:
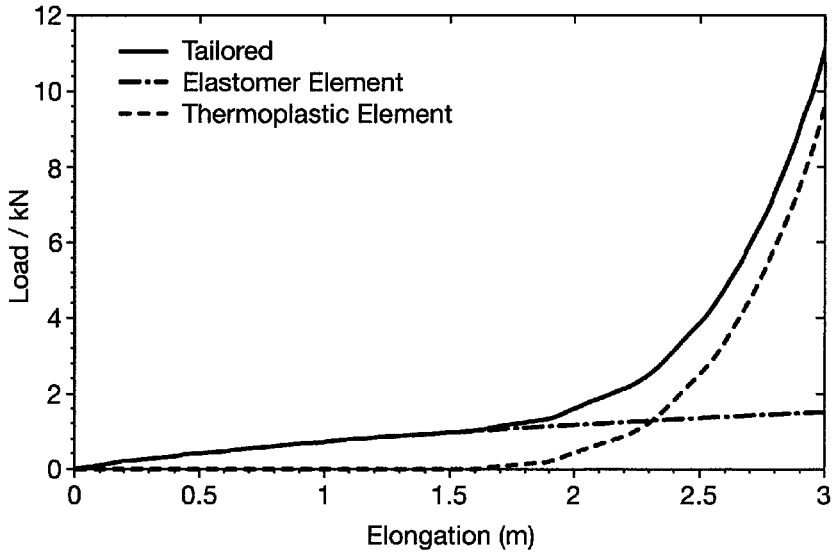
FIG. 4 shows a tailored a composite response curve for a mooring component according to an embodiment of the present invention.

FIG. 4 shows how a desired non-linear response curve for a mooring component can be generated from the combination of a tensile elastomeric element and a compressive elastomeric (e.g. thermoplastic) element. The solid line shows the total response, while the dashed lines show the individual contributions from the tensile ("elastomer") element and the compressive ("thermoplastic") element. The desired response has a long region of low stiffness expansion. In an ideal scenario this would be almost flat with the same load being applied irrespective of the elongation. This range would correspond to the typical orbital motion of a floating device in normal environments. In extreme environments where the orbital motion or the combined orbital and current motion becomes larger, a higher response is required and this is delivered by the compressive element. This matching of a soft response in normal operating conditions with a stiff, but not nearly infinite, response in extreme conditions allows for a minimisation of the loads across all operating conditions. It is important that such a response is smooth so as to minimise any peak loads or shocks to the mooring system. A traditional elastomeric mooring hawser such as those supplied by Seaflex, Hazelette, Supflex and others, containing a steel bypass loop, would effectively have an infinite increasing slope at the end of the response curve. If such a point were to be reached this would cause extreme shock forces in the mooring, risking failure.

Figure 5:
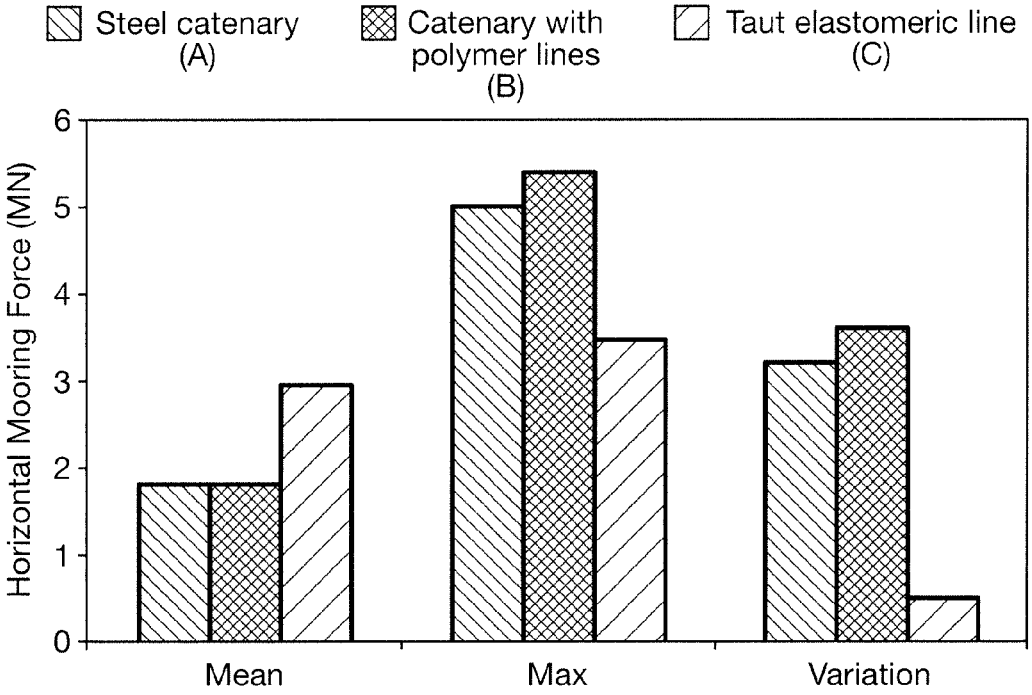
FIG. 5 shows the horizontal mooring forces in a system depending on the type of mooring component.

FIG. 5 provides a comparison between a catenary system with steel lines (A), a catenary system with polymer lines (B) and a taut mooring system (C) such as that shown in the embodiment of FIG. 2. In an extreme load case such as a 100 year storm the total maximum horizontal mooring force may be ~5 MN, with a variation in loading of ~3.2 MN. It can be seen that the maximum forces in systems A and B are much larger than in system C. Moreover it can be seen that the variation in the forces on the mooring system is very large for systems A and B, but that in system C the forces vary across a limited range of only 0.5 MN. Thus mooring system C is able to cope much more efficiently with changes in wave height than conventional systems, as a result of the elastomeric mooring component's nearly constant stress-strain response and low force across a large range of elongation e.g. 20-70%.

As compared to a catenary system, elastomeric mooring components according to embodiments of the invention can significantly reduce the mooring forces on the system, for example by >75%.

Figure 6:
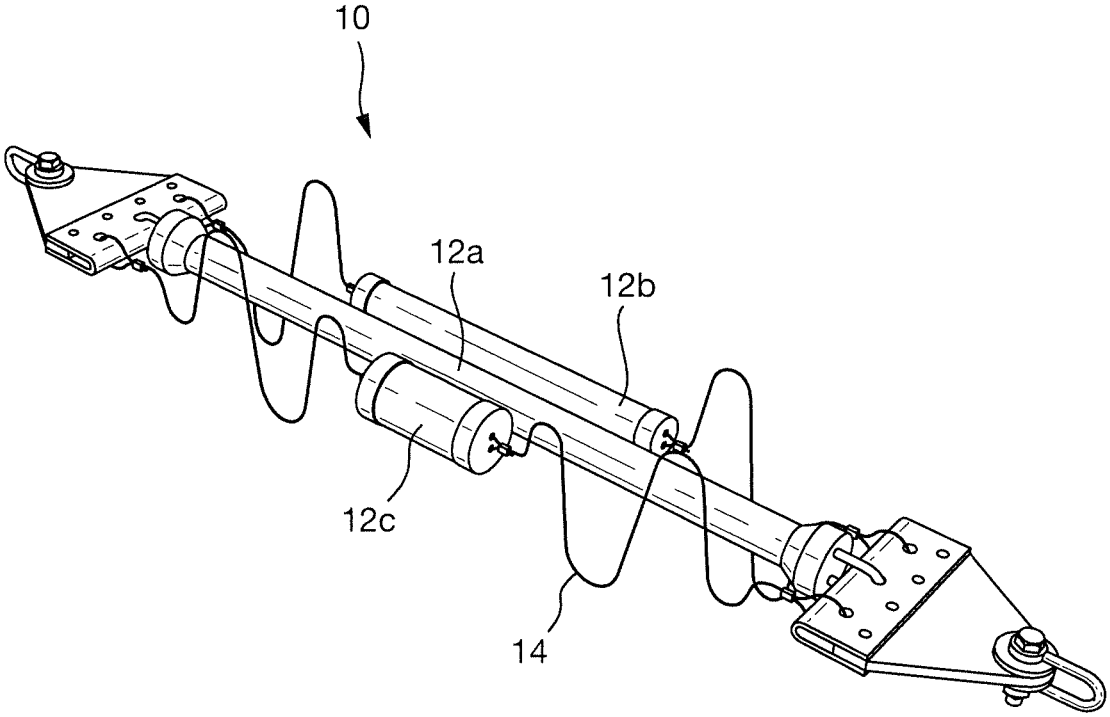
FIG. 6 is a perspective view of a first embodiment of a mooring component according to the present invention, in an unstretched configuration.

There is shown in FIG. 6 a first embodiment of a mooring component 10 according to the present invention comprising three elastomeric tensile elements 12*a*-12*c* arranged in parallel. The middle element 12*a* has a length L that matches the tensile length of the component, which may be 16 m. Another element 12*b* has a length L'<L that may be 8 m. Another element 12*c* has a length L'<L that may be 4 m. The two shorter elements 12*b*, 12*c* are connected to the ends of the component by steel cables 14. Although the elastomeric elements 12*a*-12*c* are shown as being laid side-by-side, they could instead be wrapped around each other in any suitable way.

Figure 7A:
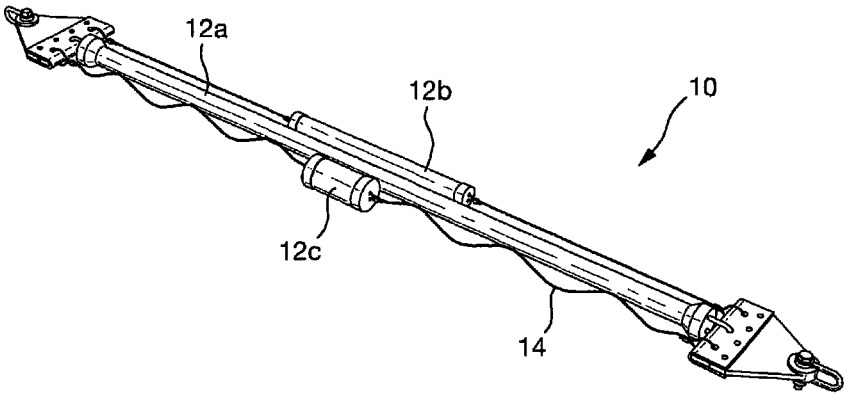
FIG. 7*a* is a perspective view of the mooring component of FIG. 6, in a semi-stretched configuration.
Figure 7B:
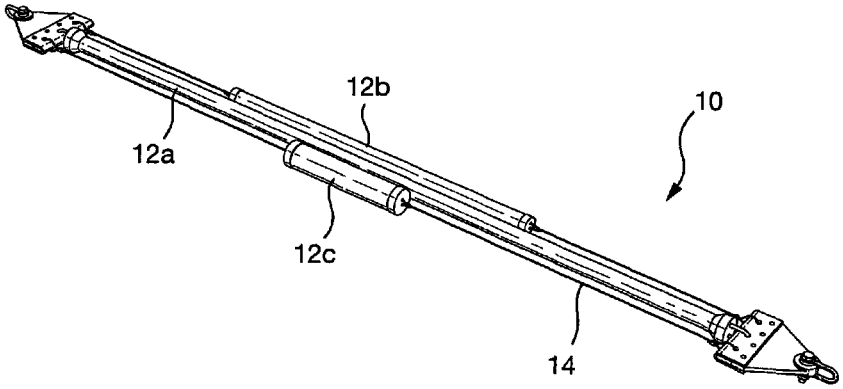
FIG. 7*b* is a perspective view of the mooring component of FIG. 6, in a fully stretched configuration.

FIGS. 7*a* and 7*b* show how the mooring component 10 of the first embodiment stretches in response to tensile stress. From FIG. 7*a* it can be seen that the middle element 12*a* corresponding to the tensile length L stretches first, while the cables 14 start to extend but the two shorter elements 12*b*, 12*c* are not initially put under tension. As the component 10 is stretched further, the cables 14 become taut and the shorter elements 12*b*, 12*c* also start to be engaged. FIG. 7*b* shows a later stage of extension wherein all three of the elastomeric elements 12*a*-12*c* are under tension and stretch to various degrees, thereby contributing to the composite stress-strain response of the component 10. The lengths, diameters and/or materials of the elastomeric elements 12*a*-12*c* can be selected to give a composite reversible non-linear stress-strain response which will provide relatively low and gradually changing mooring forces on the component in response to the expected environmental loading i.e. wave states.

Figure 8:
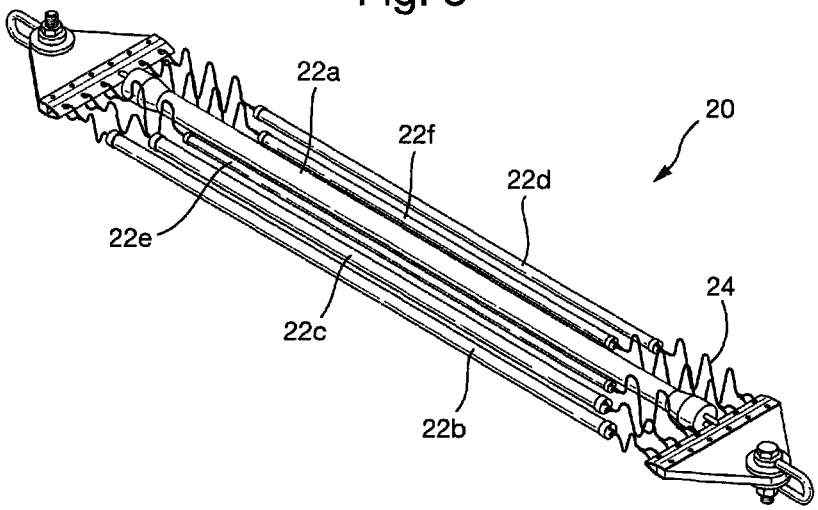
FIG. 8 is a perspective view of a second embodiment of a mooring component according to the present invention.

FIG. 8 shows a second embodiment of a mooring component 20 according to the present invention comprising six elastomeric tensile elements 22*a*-22*f* arranged in parallel. Both FIGS. 7 and 8 show mooring components that could have a tensile length L of 16 m. In the embodiment seen in FIG. 8 each of the six elements 22*a*-22*f* has a different length and diameter. Five of the elastomeric elements 22*b*-22*f* have a length L'<L and are connected to the ends of the component 20 by steel cables 24. It will be appreciated that the lengths and diameters of the elements 22*a*-22*f* can depend on the tensile strength of the elastomeric material used. Using material with a tensile strength ~6 MPa, the dimensions of the six different elements may be, for example, as listed in Table 1.

TABLE 1

Mooring component element dimensions

| Element | Length/m | Diameter/m |
|---|---|---|
| 22a | 16 | 0.5 |
| 22b | 15.7 | 0.3 |
| 22c | 14.2 | 0.28 |
| 22d | 13.4 | 0.18 |
| 22e | 12.6 | 0.22 |
| 22f | 11.1 | 0.21 |

If the mooring component shown in FIG. 8 were to be made up of tensile elements each having a length≥the tensile length L of the component (e.g. 16 m), then for material with a tensile strength ~6 MPa the mooring component would have a total weight of ~10 T. However, by using only one element of length L and several elements of length L'<L instead, with the shorter elements connected to the ends of the mooring component by steel cables 24, the total weight of the component can be reduced to ~7 T using elastomeric material of the same tensile strength. A further weight reduction may be achieved by using even higher strength elastomeric materials for one or more of the elements.

Figure 9:
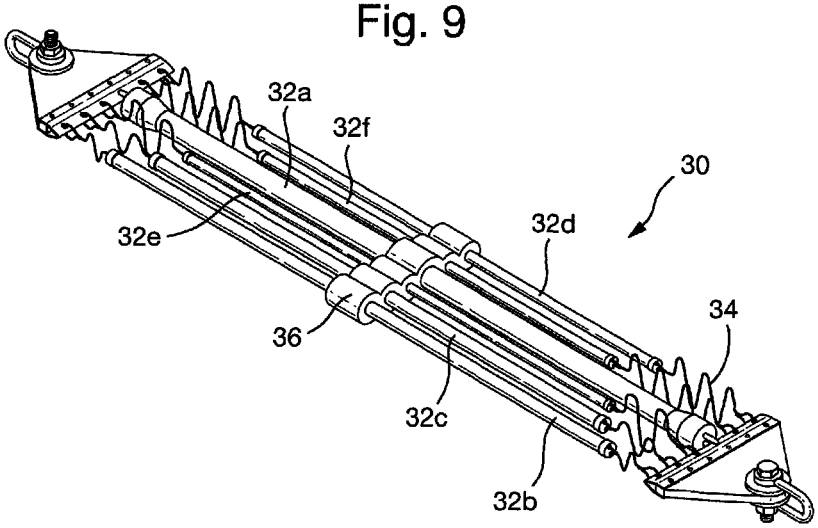
FIG. 9 is a perspective view of a third embodiment of a mooring component according to the present invention.

FIG. 9 shows a third embodiment of a mooring component 30 according to the present invention. This component is similar to FIG. 8 in that there are six elastomeric tensile elements 32*a*-32*f* arranged in parallel, but in addition the component 30 also includes a central guide member 36 to separate the elements 32*a*-32*f* laterally. Such a guide member 36 may help to ensure that there is no contact between the elements 32*a*-32*f* as the component 30 moves and stretches, or at least that the elements 32*a*-32*f* do not become entangled. In this example the guide member 36 comprises a row of six separated passages for the elastomeric elements 32*a*-32*f*. The guide member 36 is designed so as not to inhibit the elements from 32*a*-32*f* from stretching and so preferably there is a low coefficient of friction between the elastomeric material of the tensile elements 32*a*-32*f* and the material of the guide member 36. Depending on the size of the component 30, the guide member 36 may possibly be used to add shape or rigidity.

Figure 10:
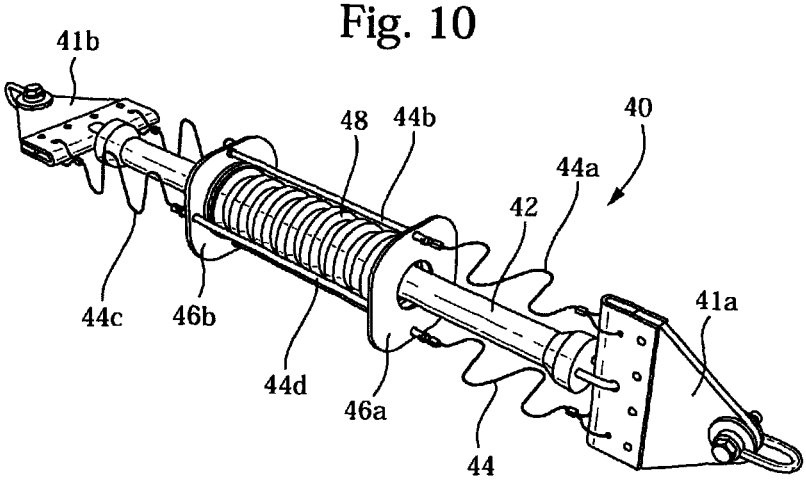
FIG. 10 is a perspective view of a fourth embodiment of a mooring component according to the present invention.

FIGS. 10 to 15 relate to further embodiments of the invention wherein at least one tensile elastomeric element 42, 52, 62, 72, 82 is connected in parallel with at least one compressive elastomeric element 48, 58, 68, 78, 88 to form a mooring component 40, 50, 60, 70, 80. In these embodiments the tensile element 42, 52, 62, 72, 82, such as an elongate element formed of elastomeric material, delivers the main expansion of the mooring component 40, 50, 60, 70, 80 at lower forces. The compressive element 48, 58, 68, 78, 88 is in the form of a corrugated tube of higher strength elastomeric material such as Hytrel®. The compressive element 48, 58, 68, 78, 88 is connected between the end connectors 41, 51, 61, 71, 81 of the mooring component such that it does not experience a tensile force until a certain elongation has been reached. Thus it will be understood that the tensile response of the mooring component 40, 50, 60, 70, 80 is a composite response made up of a contribution from the tensile element 42, 52, 62, 72, 82 mainly at lower elongations and a contribution from the compressive element 48, 58, 68, 78, 88 mainly at larger elongations. The elastomeric elements can be selected and designed to provide a smooth tensile response curve having the general form seen in FIG. 3 or 4. Expansion of the mooring component 40 of FIG. 10 is seen in FIGS. 12*a* to 12*c*.

Figure 11:
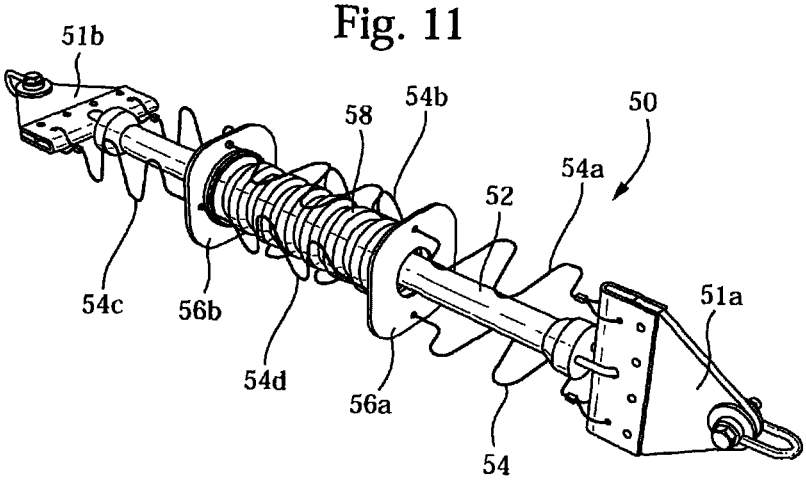
FIG. 11 is a perspective view of a fifth embodiment of a mooring component according to the present invention.
Figure 12A:
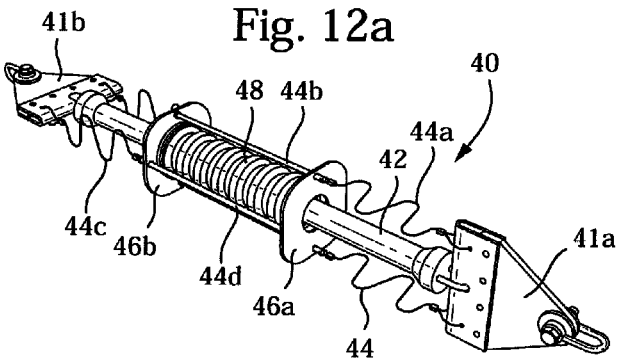
FIG. 12*a* is a perspective view of a mooring component according to the fourth embodiment of the present invention, in an unstretched configuration.
Figure 12B:
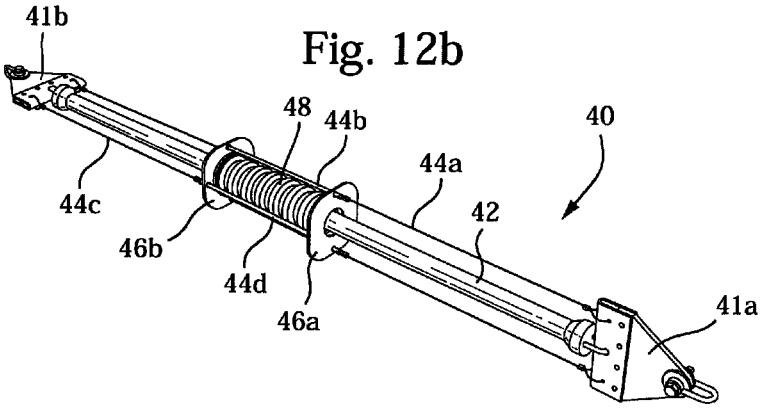
FIG. 12*b* is a perspective view of the mooring component of FIG. 12*a*, in a semi-stretched configuration.
Figure 12C:
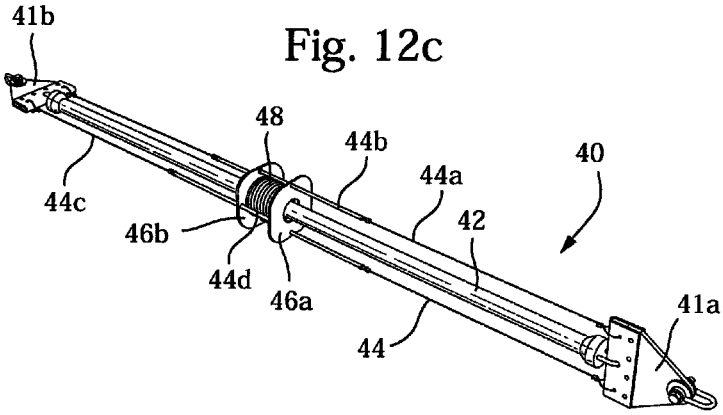
FIG. 12*c* is a perspective view of the mooring component of FIGS. 12*a* and 12*b*, in a fully stretched configuration.

In the embodiments of FIGS. 10 to 12 the compressive element 48, 58 is mounted between a stationary plate 46*a*, 56*a* and a moveable plate 46*b*, 56*b* with steel cables 44, 54 transmitting tensile stress to the compressive element 48, 58. It can be seen that there are four cables 44, 54, e.g. steel cables, two cables extending from one end connector 41*b*, 51*b* to the moveable plate 46*b*, 56*b* and two cables extending from the other end connector 41*a*, 51*a* and passing through the stationary plate 46*a*, 56*a* before attaching to the moveable plate 46*b*, 56*b* at the other end of the compressive element 48, 58. It will be seen with reference to FIG. 12 that the stationary plate 46*a*, 56*a* does not move in the frame of reference of the compressive element 48, 58 as the cables 44, 54 are all attached to the moveable plate 46*b*, 56*b* and it is the moveable plate 46*b*, 56*b* that is pulled towards the stationary plate 46*a*, 56*a* to compress the element 48, 58 therebetween. In the frame of reference of the overall mooring component 40, 50, the compressive element 48, 58 with its end plates 46*a*, 46*b*, 56*a*, 56*b* can be free to move relative to the tensile element 42, 52 depending on the relative elongation of the cables 44, 54 as compared to that of the tensile element 42, 52.

The cables 44, 54 are shown to have a serpentine configuration along at least part of their length, so that they will extend from their original length before starting to transmit tensile stress to the compressive element 48, 58. In FIG. 10 the two cables 44 that pass through the stationary plate 46*a* are serpentine at 44*a* between the end connector 41*a* and the compressive element 48 but straight at 44*b* along the length of the compressive element 48 and the two cables 44 that pass through the moveable plate 46*b* are serpentine at 44*c* between the end connector 41*b* and the compressive element 48 but straight at 44*d* along the length of the compressive element 48 to the fixed plate 46*a*. This can help to ensure a smooth passage of the cables 44 through the stationery plate 46*a* as they pull on the moveable plate 46*b* to compress the element 48. On the other hand, in FIG. 11 the cables 54 are serpentine along their whole length at 54*a*, 54*b*, 54*c*, 54*d* and hence this mooring component 50 is designed to provide a stiff response from the compressive element 58 at greater elongations than the mooring component 40 of FIG. 10 The stiffness and/or configuration of the cables 44, 54 can be adjusted to selectively transmit tensile force to the compressive element 48, 48 at a desired elongation depending on the desired response curve for the mooring component 40, 50, which may be tailored to the expected environmental loading for the location at which the mooring is to be used.

Figure 13:
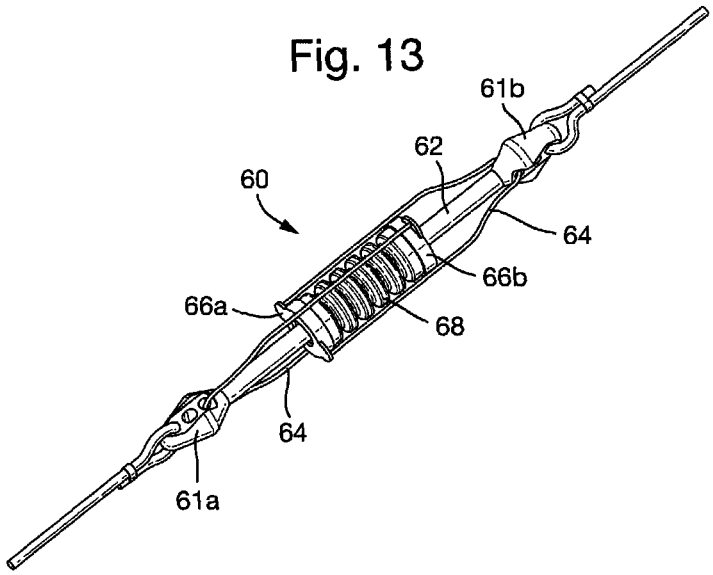
FIG. 13 is a perspective view of a sixth embodiment of a mooring component according to the present invention.
Figure 14:
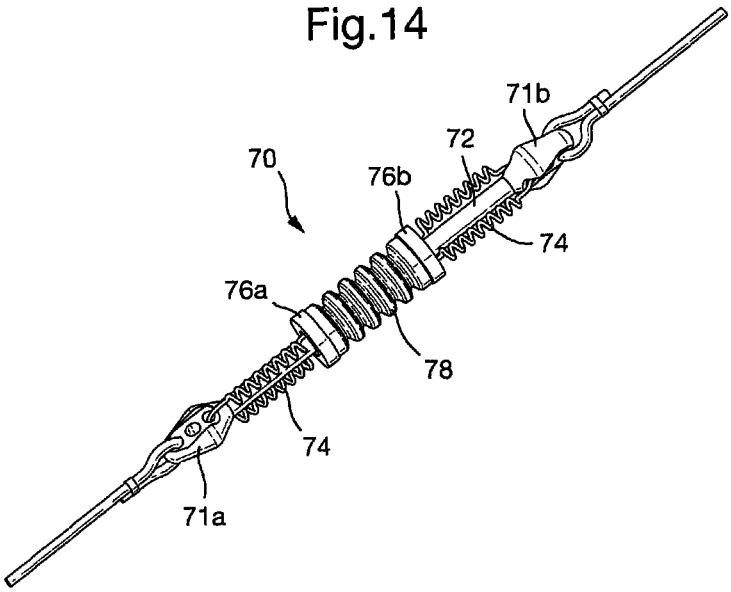
FIG. 14 is a perspective view of a seventh embodiment of a mooring component according to the present invention.

FIGS. 13, 14 and 15 show other embodiments of the invention wherein at least one tensile elastomeric element 62, 72, 82 is connected in parallel with at least one compressive elastomeric element 68, 78, 88 to form a mooring component 60, 70, 80. In the embodiments of FIGS. 13 to 15, one or more stiff cables 64, 74, 84 are operatively connected to both end members 66*a*, 66*b*, 76*a*, 76*b*, 86*a*, 86*b* of the compressive element 68, 78, 88 so that as the cables 64, 74, 84 are put under tensile stress they pull on the opposed ends 66*a*, 66*b*, 76*a*, 76*b*, 86*a*, 86*b* of the compressive element 68, 78, 88 so that it compresses as it undergoes strain. In FIG. 13 it can be seen that the cables 64 may pass substantially straight from one end connector 61*a* to the opposite end member 66*b* of the compressive element 68, and from the other end connector 61*b* to the opposite end member 66*a*. When the mooring component 60 is put under tensile stress, the elastomeric element 62 will stretch first as it is elastic compared to the stiff cables 64. As the stress increases the cables 64 will start to transmit a tensile stress to the compressive element 68 so that it begins to undergo strain. In FIGS. 14 and 15 it can be seen that the cables 74, 84 are coiled at least along part of their length and thus may provide an initial tensile response as they stretch, before the compressive element 78, 88 is put under strain. These mooring components 70, 80 are designed to provide a stiff response from the compressive element 78, 88 at greater elongations than the mooring component 60 of FIG. 13. In FIG. 15 there is also seen an outer casing formed of two halves 89*a*, 89*b*, each connected to a respective end connector 81*a*, 81*b*, but this adds no physical impact on the response of the system.

Figures 15A, 15B, 15C:
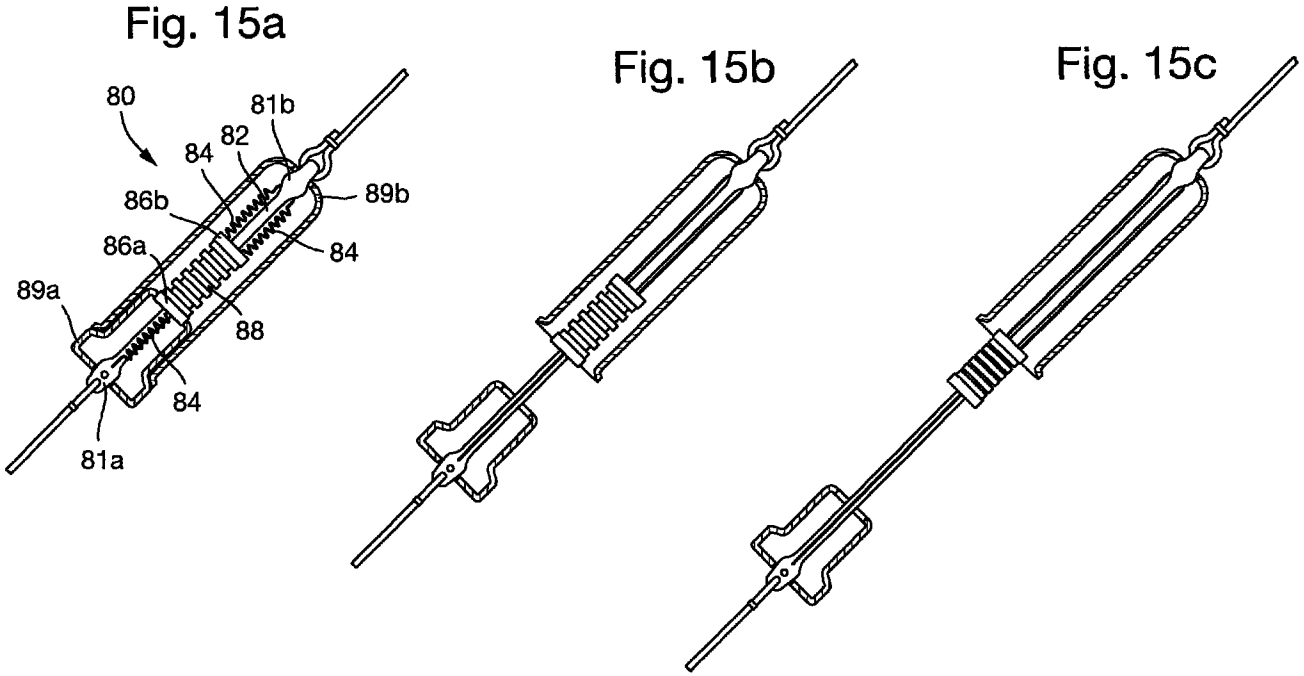
FIG. 15 is a perspective view of an eighth embodiment of a mooring component according to the present invention.

FIGS. 15*a*-15*c* show the component 80 under different load scenarios. In this implementation the core elastomeric element 82 extends between the two end connectors 81*a*, 81*b* with coiled steel cables 84 connecting each end connector 81*a*, 81*b* of the elastomeric element 82 to the opposite end of the compressive element 88. As the component 80 is stretched, FIG. 15*b* shows the point at which the coiled steel cable 84 is fully uncoiled. This may be designed to correspond to the maximum extension required in normal operating conditions. The load response of the system is delivered solely by the elastomeric element 82 up to this point. As the component 80 is stretched further, the load is now transferred onto the much stiffer compressive element 88. This element 88 compresses, delivering a much higher load response over a much shorter elongation length, protecting the elastomeric element 82 from being stretched too far.

It can seen from comparing FIGS. 6 to 12 with FIGS. 13 to 15 that the end connectors for a mooring component can be selected independently of the number and type of elastomeric and/or compressive elements used. In FIGS. 6-12 the end connectors, for example connectors 41, 51 seen in FIGS. 10-11, are provided separately from the tensile component(s) and connected thereto. A stiff, non-elastic connection is used. In FIGS. 13-15 the end connectors 61, 71, 81 are provided integrally by the respective tensile component 62, 72, 82, for example the ends of each elastomeric component 62, 72, 82 are moulded into an end piece 61*a*, 61*b*, 71*a*, 71*b*, 81*a*, 81*b* comprising one or more holes or loops etc. to enable a connection to be made to the rest of the mooring system. Such integral elastomeric connectors may be preferred where it is desired to reduce the number of separate components in the mooring and/or to reduce the number of non-polymeric components, such as steel connectors, that may be prone to corrosion in the harsh marine environment.

In the embodiments of FIGS. 10 to 15 the compressive element 48, 58, 68, 78, 88 is designed to deliver high counterforces at extreme expansions as it undergoes compression. The elastomeric material e.g. rubber used for the tensile element 42, 52, 62, 72, 82 can be relatively low strength, for example 1.2 MPa, while the elastomeric material e.g. Hytrel® used for the compressive element 48, 58, 68, 78, 88 can be relatively high strength, for example 30 MPa.

It will be understood that the embodiments of FIGS. 10 to 15 enable the weight of the mooring component to be reduced even further as compared to the embodiments of FIGS. 6 to 9. If the same elastomeric material is used for all of the tensile elements in a mooring component, then for the component to withstand forces of 2.5 MN with rubber elements having a strength ~1.2 MPa requires a total material cross-section >2 $m^2$. For a 75% elongation the material volume required would be ~15 $m^3$, equating to a weight of ~16.5 T. If the rubber tensile elements of strength ~1.2 MPa are combined with a compressive element of strength ~30 MPa then the component may instead comprise only ~1 $m^2$ in cross-section of rubber material (contributing 1.2 MN of counterforce) and ~0.05 $m^2$ in cross-section of elastomeric material in the compressive element (contributing 1.5 MN of counterforce). The overall material volume is reduced to <10 $m^3$ and the weight of the mooring component is reduced to ~10 T.

It will be appreciated that the embodiments of FIGS. 10 to 15 illustrate the basic elements of a mooring component that combines a tensile elastomeric element with a compressive elastomeric element, but that such a mooring component may take various different forms. For example, a plurality of tensile elements could run in parallel to the compressive element. One, two, three, four, five or six more tensile elements could be used. Such tensile elements could have different lengths, thicknesses, and/or materials, along similar lines to those described above. However an advantage of using a compressive elastomeric element in combination with one or more tensile elastomeric elements is that fewer elements may be required overall to achieve a desired composite stress-strain response for the mooring component. The number and configuration of the cables can also be varied depending on the desired response curve. Of course the cables that operatively connect the compressive element in the mooring component may not be steel but could be formed of any stiff material such as Kevlar® or Dyneema®.

A number of variations on the designs described above are possible. One implementation could have the compressive element attached to one end of the component rather than in the centre. This reduces the complexity and allows for it to be integrated into the connector design. Another implementation could move the compressive element outside of the elastomeric element, with no need to run the elastomeric element down the centre of the compressive element. This is particularly suited for applications with multiple elastomeric elements or where a parallel array of compressive elements is used.

In an advantageous construction the compressive elastomeric element 48, 58, 68, 78, 88 takes the form of a hollow corrugated tube with at least one tensile element 42, 52, 62, 72, 82 passing therethough. This provides a compact arrangement with the elements connected to receive a tensile stress in parallel, as well as minimising material volume. While a tensile element 42, 52, 62, 72, 82 has been shown as passing through a hollow compressive element 48, 58, 68, 78, 88 it will be understood that one or more tensile elements could instead run alongside, rather than through, the compressive element. The compressive element could be solid instead. Furthermore, more than one compressive element may be used, with the compressive elements connected in series and/or in parallel in the mooring component.

Figure 16:
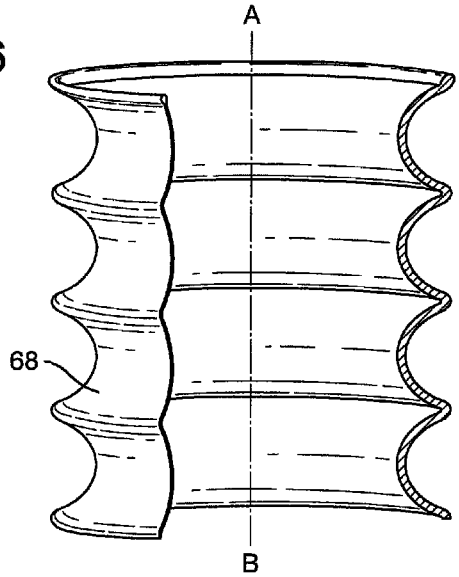
FIG. 16 is a schematic broken view of a cylindrical compressive element suitable for use in the fourth to eighth embodiments of a mooring component.
Figure 17:
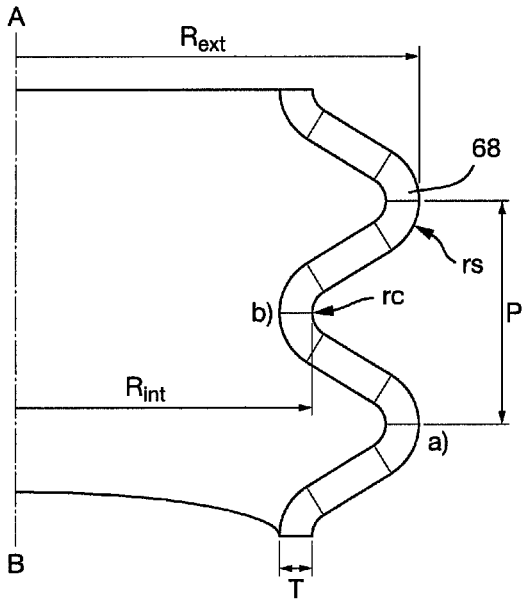
FIG. 17 is a cross-sectional view of the element shown in FIG. 16, taken along the line A-B.

One example of a cylindrical compressive element 68 is shown schematically in FIG. 16, with the line A-B designating the symmetry axis of the element 68. In FIG. 17, T designates the thickness, P designates the pitch, a) designates a peak, b) designates a valley, $R_{int}$ designates the diameter of the valley, $R_{ext}$ designates the diameter of the peak, rc designates the fillet radius at minimum outer diameter of bellows, and rs designates the fillet radius at maximum outer diameter of bellows. It is possible to vary the elastic response of the compressive member by varying the wall thickness T, varying the ratio of the diameter of the peaks to the diameter of the valleys by means of varying the diameter/radius of the peaks ($R_{ext}$) and diameter/radius of the valleys ($R_{int}$), by varying the number of bellows/convolutes, by varying the pitch P or by varying the fillet radius at minimum outer diameter of bellows (rc) and the fillet radius at maximum outer diameter of bellows (rs).

In one embodiment the cylindrical member has the following relative dimensions: P=P, $R_{ext}$=4 P to 5.5 P, preferably 4.8 P, T=0.1 P to 0.5 P, preferably 0.2 P, rc=0.08 P to 0.1 P, preferably 0.083 P, and rs=0.25 P to 0.4 P, preferably 0.3 P.

Figure 18:
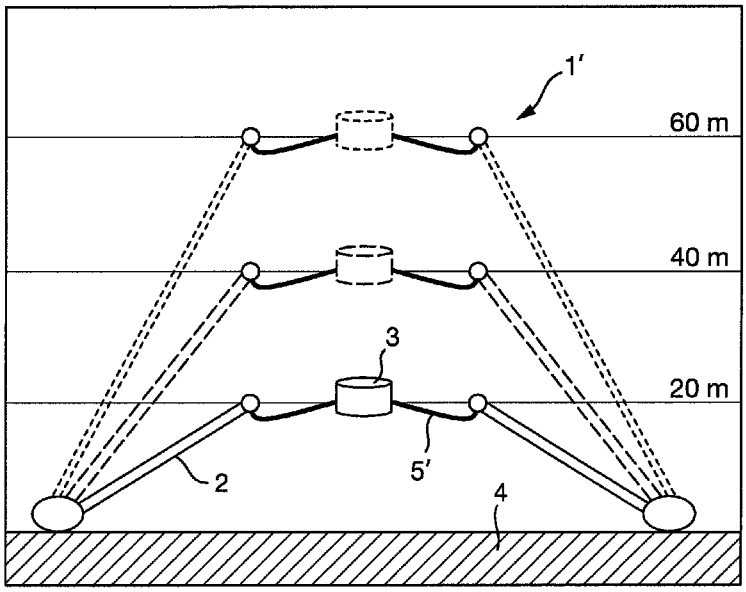
FIG. 18 is a schematic representation of a mooring system according to another embodiment of the present invention.

FIG. 18 shows another embodiment of a mooring system 1' according to the present invention. The mooring system 1' comprises a pair of mooring components 2 according to any of the above-described embodiments of the invention, which are directly connected to the seabed 4 and which are connected to a floating body 3 by means of a surface or subsurface buoy 8 and a loose intermediate line 5'. The mooring system 1' achieves its function with a non-changing minimal footprint and with a low loading on the anchor system. The choice of mooring system 1 often depends on the type of loading required for a particular floating body.

Figure 19:
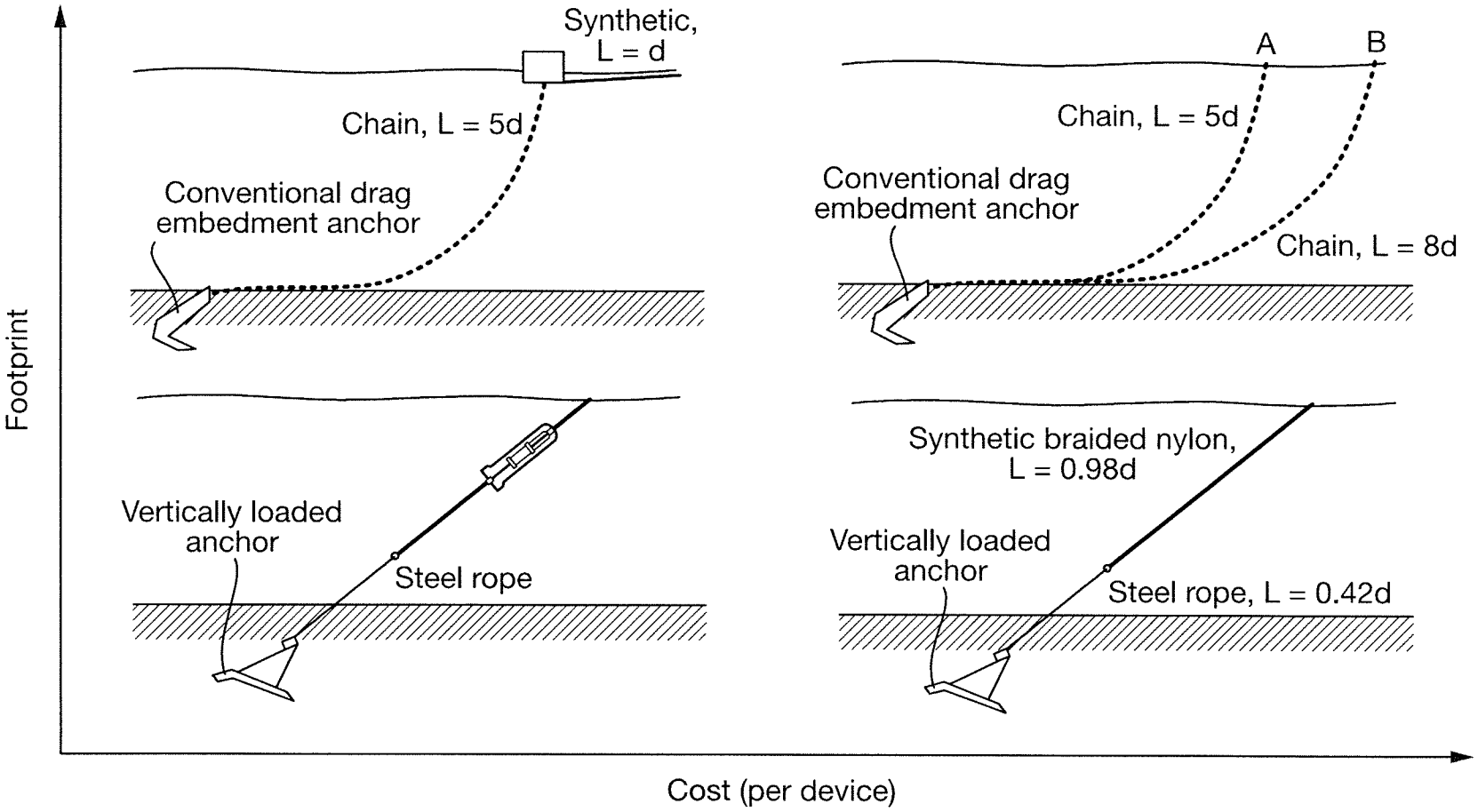
FIG. 19 provides a comparison between different mooring systems in terms of footprint vs. cost.

FIG. 19 shows that there are many ways in which a mooring component can be used in systems with a wide variety of mooring architectures. Smaller footprints are achieved by using a taut mooring system, but this often leads to higher costs as the vertically loaded anchor (VLA) is expensive if significant vertical loads are present. A system using a mooring component according to an embodiment of the invention, as seen in the bottom left example, can achieve much lower loads and thus can use much smaller anchors, dramatically reducing costs. This is the case whether the component is applied on a direct line to the device being mooring or in a system using surface or subsurface floats.

Figure 20:
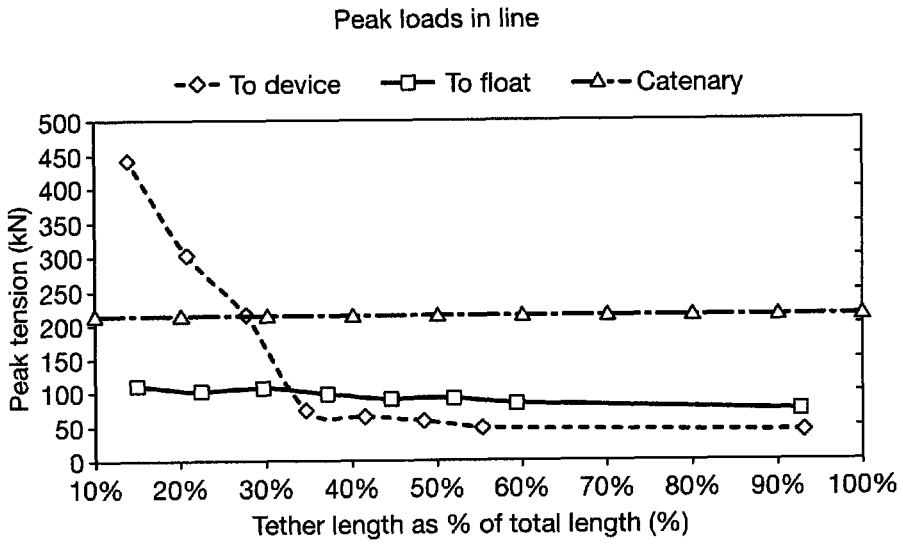
FIG. 20 compares the performance of three different mooring systems.

FIG. 20 shows an example of three different mooring architectures and how they perform under the same conditions. It is important to design the component to match the expected environmental conditions. As discussed previously, the elastomeric element can be sufficiently long to cover the orbital motion in normal operating conditions. The first curve (diamonds) shows the response of a preferred mooring component connected between the seabed and a device being moored. As the length of the component is increased (with respect to the total length of the mooring leg) the peak load drops. Once the elastomeric element is greater than ~35% of the total length (in this scenario) the loads have been minimised. This equates to the orbital motion of the device. The second curve (squares) shows the response of a preferred mooring component when connected to a float with a rope connection to the device being moored. In this scenario there is a much shorter minimal length to the component as the rope allows for the orbital motion but the peak loads are higher and the footprint would be much higher. The final curve (triangles) shows the loads experienced by a catenary chain linked directly to the device being moored. In this case the chain is always 100% of the total length and runs along the seabed for a few hundred meters so that no vertical loads exist at the anchor point. The load is always high in such a catenary mooring system.

Figure 21A:
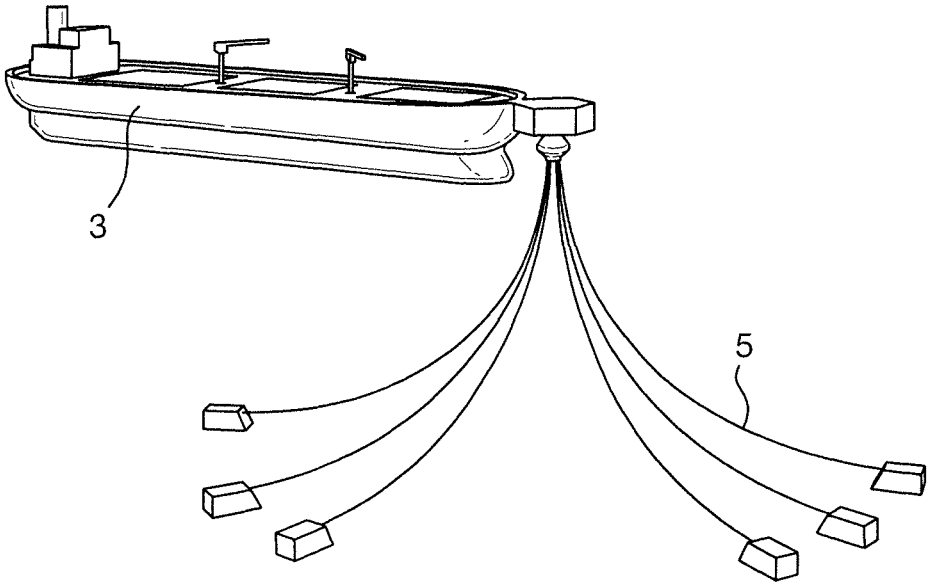
FIG. 21*a* is a schematic view of a conventional mooring system for a ship.
Figure 21B:
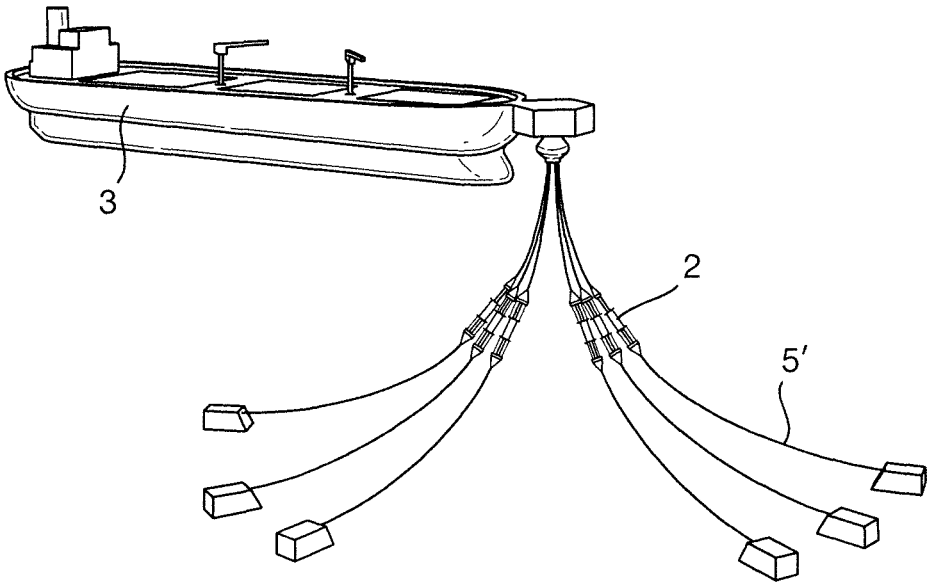
FIG. 21 *b* is a schematic view of a mooring system for a ship according to an embodiment of the present invention.

FIG. 21*a* depicts a conventional catenary mooring system for a ship 3 in which several synthetic mooring lines or steel chains 5 are anchored to the seabed. It can be seen that the lines or chains must be long, e.g. up to 2 km, in order to cope with changes in water depth and to provide the required load along the surface of the seabed. The length of the chain 5 must provide sufficient weight to resist horizontal forces when the heavy ship moves, even on relatively small e.g. 5 m waves. In FIG. 21*b* there is shown a mooring system comprising components 2 according to any of the above-described embodiments connected between the ship 3 and anchored mooring lines 5'. In this system the lines 5' in the mooring system can be much shorter because the components 2 allow for a large degree of elongation and provide a composite stress-strain response in which the load is reduced. The elastomeric components 2 may even reduce the vertical forces in the mooring system to a level that means anchors can be connected directly to the ocean floor instead of laying chains along the seabed.

FIGS. 22 and 23 show published mooring architecture for an attenuator-type wave energy conversion (WEC) device such as is available from Pelamis Wave Power Limited. The device is a semi-submerged, articulated structure composed of cylindrical sections linked by hinged joints. The wave-induced motion of these joints is converted into electricity by hydraulic rams. Current production devices are 150-180 m long and 4-6 m in diameter. Each device requires its own individual mooring spread consisting of the main moorings and a yaw restraint line. The main moorings consist of a number of anchors connected to a central point. The yaw restrain line is a simple single anchor and mooring line configuration. The mooring spread should be designed to minimise its footprint area, allowing the highest concentration of power capacity to seabed space and reducing infrastructure costs.

Figure 22A:
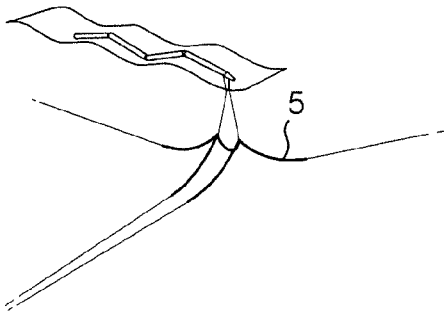
FIGS. 22*a* and 22*b* show how a conventional mooring system reacts to environmental loading for an attenuator-type wave energy conversion (WEC) device.
Figure 22B:
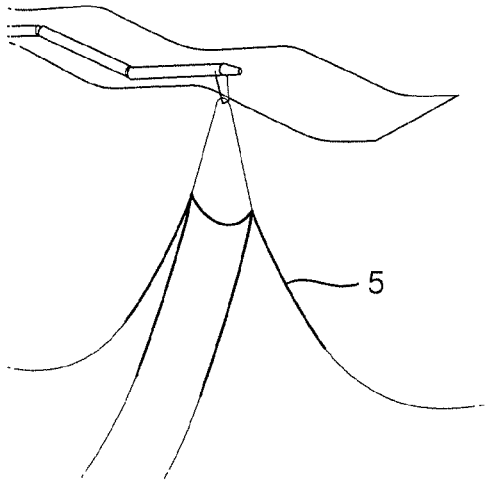
Figure 23A:
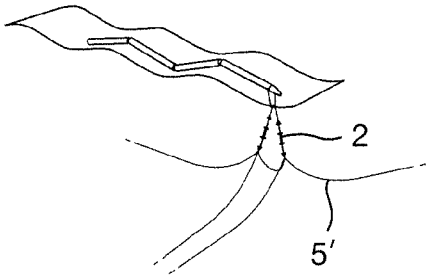
FIGS. 23*a* and 23*b* show how a mooring system according to an embodiment of the present invention reacts to environmental loading for an attenuator-type wave energy conversion (WEC) device.
Figure 23B:
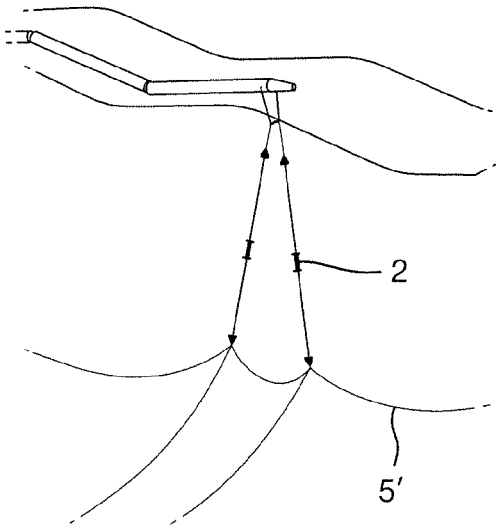

It can be seen from FIGS. 22*a* and 22*b* that using conventional catenary mooring lines 5 e.g. steel chains it can be difficult to minimise the footprint of the device as a large amount of chain must be lifted from the seabed to enable the device to react to wave and/or tidal motion. In FIGS. 23*a* and 23*b*, on the other hand, the mooring system includes one or more elastomeric mooring components 2 according to any of the above-described embodiments of the invention, e.g. connected between the device and the anchor lines 5'. As the mooring components 2 are able to elongate by 100% or more, even up to 250% elongation, the footprint of the mooring system is much smaller. This makes it easier to connect several devices together in an array. For example, a mooring component having an initial tensile length of 18 m may allow elongations of 30-40 m while withstanding forces of 5 MN. Furthermore, the loading forces on the mooring system may be 70% lower when elastomeric components are used in place of steel catenary lines.

From the above description it will be understood that mooring components and mooring systems in accordance with the present invention advantageously provide a small scope, i.e. allowing large wave height changes with respect to depth, and can also reduce the horizontal motion envelope and seabed footprint of a device being moored. Furthermore the composite stress-strain response of the mooring component can be optimised for the expected sea states at a device's mooring location so that in normal conditions the mooring component can deliver a nearly constant counterforce but in extreme conditions the response smoothly increases to provide a large counterforce and high elongation rate (e.g. >10 m/s) that allows for protection from high sea states. Furthermore the mooring components may have a long lifetime and low fatigue in seawater due to the elastomeric materials used.

Although the present invention has been described with reference to preferred embodiments, it will be understood by those skilled in the art that various changes in form and detail may be made without departing from the scope of the invention as set forth in the accompanying claims.

The invention claimed is:

1. A mooring component comprising at least one tensile element and at least one compressive element, both the tensile and compressive elements being configured to undergo strain in response to a tensile stress wherein the at least one tensile element is connected in the mooring component such that the at least one tensile element gives a tensile response providing a tensile force as the at least one tensile element is stretched as the mooring component undergoes extension and, the at least one compressive element is connected in the mooring component such that the at least one compressive element is compressed in response to extension of the mooring component beyond a certain threshold wherein the at least one tensile element and the at least one compressive element are formed of an elastomeric material.

2. A mooring component as claimed in claim 1, wherein the at least one tensile element and at least one compressive element are configured to respond to the tensile stress in parallel.

3. A mooring component as claimed in claim 1, wherein a stress-strain response of the mooring component is a composite elastic response resulting from a combination of a response from each of the least one tensile element and the at least one compressive element.

4. A mooring component as claimed in claim 1, comprising at least one, two, three, four, five, six or more elastomeric tensile elements configured to provide a tensile response to said tensile stress.

5. A mooring component as claimed in claim 1, comprising at least one, two, three or more elastomeric compressive elements configured to provide a compressive response to said tensile stress.

6. A mooring component as claimed in claim 1, comprising at least one tensile element having a length L equal to the tensile length of the mooring component and at least one compressive element having a length L'<L.

7. A mooring component as claimed in claim 1, wherein the at least one compressive element comprises an elastomeric material having a higher elastic modulus than that of one or more said tensile element(s).

8. A mooring component as claimed in claim 1, wherein the at least one tensile element comprises a plurality of different deformable elastomeric elements which have different lengths and/or thicknesses and/or are formed of different elastomeric materials.

9. A mooring component as claimed in claim 1, wherein the at least one compressive element comprises a cylindrical corrugated or bellowed member formed of elastomeric material.

10. A mooring system comprising one or more mooring components according to claim 1, wherein the one or more mooring components are connected, directly or indirectly, between a floating body and a seabed.

11. A method of manufacturing a mooring component for a deep sea mooring system, comprising the steps of:

identifying a body to be moored and a location in which it is to be moored;

determining an expected environmental loading on the body at the location;

determining a stress-strain response required for the mooring component to respond to the expected environmental loading with a desired modification of a plurality of mooring forces on the component; and forming the mooring component from at least one tensile element and at least one compressive element, both the tensile and compressive elements being configured to undergo strain in response to a tensile stress wherein the at least one tensile element is connected in the mooring component such that the at least one tensile element gives a tensile response providing a tensile force as the at least one tensile element is stretched as the mooring component undergoes extension and, the at least one compressive element is connected in the mooring component such that the at least one compressive element is compressed in response to extension of the mooring component beyond a certain threshold wherein the at least one tensile element and the at least one compressive element are formed of an elastomeric material.

12. The method of claim 11, wherein the at least one tensile element and the at least one compressive element respond to the tensile stress in parallel.

13. The method of claim 11, wherein a stress-strain response of the mooring component is a composite elastic response resulting from a combination of a response from each of the least one tensile element and the at least one compressive element.

14. The method of claim 11, further comprising: providing the at least one tensile element with a length L equal to a tensile length L of the mooring component and providing the at least one compressive element with a length L' wherein L'<L.

15. The method of claim 11, further comprising: forming the at least one compressive element with a higher elastic modulus than the at least one tensile element.

16. The method of claim 11, further comprising: forming the at least one tensile element from a plurality of different deformable elastomeric elements which have different lengths and/or thicknesses and/or are formed of different elastomeric materials.

17. The method of claim 11, further comprising: forming the at least one compressive element as a cylindrical corrugated or bellowed member formed of elastomeric material.

* * * * *